US012305356B2

(12) United States Patent
Izumikawa

(10) Patent No.: US 12,305,356 B2
(45) Date of Patent: May 20, 2025

(54) SHOVEL

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 933 days.

(21) Appl. No.: 17/034,466

(22) Filed: Sep. 28, 2020

(65) Prior Publication Data

US 2021/0010227 A1 Jan. 14, 2021

Related U.S. Application Data

(63) Continuation of application No. PCT/JP2019/013713, filed on Mar. 28, 2019.

(30) Foreign Application Priority Data

Mar. 30, 2018 (JP) ..... 2018-068048

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2004* (2013.01);
(Continued)

(58) Field of Classification Search
CPC . E02F 3/435; E02F 3/32; E02F 9/2004; E02F 9/2033; E02F 9/2203; E02F 9/2271;
(Continued)

(56) References Cited

U.S. PATENT DOCUMENTS 6,415,604 B1 * 7/2002 Motomura ..... E02F 9/2033 91/419
7,752,779 B2 * 7/2010 Schoenmaker ..... E02F 3/439 701/50
(Continued)

FOREIGN PATENT DOCUMENTS

EP 2586918 5/2013
EP 2642754 9/2013
(Continued)

OTHER PUBLICATIONS

International Search Report for PCT/JP2019/013713 mailed on Jun. 18, 2019.

*Primary Examiner* — Mohamed Abdo Algehaim
(74) *Attorney, Agent, or Firm* — IPUSA, PLLC

(57) ABSTRACT

A shovel (100) according to an embodiment of the present invention includes a lower travelling body (1), an upper pivot body (3) pivotably mounted to the lower travelling body (1), an excavation attachment (AT) provided to the upper pivot body (3), a plurality of actuators that operate the excavation attachment (AT), an operation device (26) provided to the upper pivot body (3), and a controller (30) configured to, in response to an operation of the operation device (26) in a first direction, operate the plurality of actuators to move a predetermined portion of the excavation attachment (AT) based on position information. The controller (30) operates the plurality of actuators in a first control mode and a second control mode based on the position information.

18 Claims, 16 Drawing Sheets

(51) Int. Cl.
*E02F 9/20* (2006.01)
*E02F 9/22* (2006.01)
*E02F 9/24* (2006.01)
*E02F 9/26* (2006.01)

(52) U.S. Cl.
CPC ..... *E02F 9/2033* (2013.01); *E02F 9/2203* (2013.01); *E02F 9/2271* (2013.01); *E02F 9/245* (2013.01); *E02F 9/265* (2013.01); *E02F 9/2228* (2013.01); *E02F 9/2285* (2013.01); *E02F 9/2292* (2013.01); *E02F 9/2296* (2013.01)

(58) Field of Classification Search
CPC ..... E02F 9/245; E02F 9/265; E02F 9/2228; E02F 9/2285; E02F 9/2292; E02F 9/2296; E02F 3/437; E02F 9/2282; E02F 9/26
USPC ..... 701/50
See application file for complete search history.

(56) References Cited

U.S. PATENT DOCUMENTS 11,391,011 B2 * 7/2022 Narikawa ..... E02F 9/20
2008/0263911 A1 * 10/2008 Shoenmaker ..... E02F 3/439 711/100
2009/0159302 A1 * 6/2009 Koch ..... E02F 9/265 172/1
2015/0308081 A1 * 10/2015 Takaura ..... E02F 3/437 701/50
2015/0368878 A1 * 12/2015 Choi ..... E02F 9/2292 701/50
2015/0376868 A1 * 12/2015 Jackson ..... E02F 9/26 701/50
2016/0002882 A1 * 1/2016 Kanari ..... E02F 9/2033 701/50
2016/0040398 A1 * 2/2016 Kitajima ..... E02F 3/435 701/50
2016/0145827 A1 * 5/2016 Kami ..... E02F 3/30 701/50
2016/0281331 A1 * 9/2016 Ikegami ..... E02F 3/438
2016/0312434 A1 * 10/2016 Shintani ..... E02F 3/3681
2016/0348343 A1 * 12/2016 Kanemitsu ..... G01S 19/14
2016/0348653 A1 * 12/2016 Ge ..... E02F 9/2217
2017/0089033 A1 * 3/2017 Matsuyama ..... E02F 9/2285
2017/0268204 A1 * 9/2017 Shimano ..... E02F 3/435
2017/0292243 A1 * 10/2017 Okada ..... E02F 3/435
2018/0119383 A1 * 5/2018 Glasser ..... E02F 9/121
2019/0112787 A1 * 4/2019 Hunold ..... F15B 21/08
2019/0169818 A1 * 6/2019 Narikawa ..... E02F 3/437
2019/0360179 A1 * 11/2019 Moriki ..... E02F 3/43
2020/0181870 A1 * 6/2020 Nakano ..... E02F 9/262
2020/0181883 A1 * 6/2020 Igarashi ..... E02F 9/2004
2020/0277751 A1 * 9/2020 Chiba ..... E02F 9/262
2020/0354920 A1 * 11/2020 Horii ..... E02F 9/2033
2021/0010226 A1 * 1/2021 Tanaka ..... E02F 9/26
2021/0054595 A1 * 2/2021 Sano ..... E02F 9/2292
2021/0123213 A1 * 4/2021 Maekawa ..... E02F 9/2282
2021/0262190 A1 * 8/2021 Ito ..... E02F 9/24
2022/0304215 A1 * 9/2022 Shirafuji ..... G05D 1/0278

FOREIGN PATENT DOCUMENTS

JP S61-028632 2/1986
JP 2000-160589 6/2000
JP 2007-009432 1/2007
JP 2013-217137 10/2013
WO 2015/025986 2/2015

* cited by examiner

SHOVEL

CROSS-REFERENCE TO RELATED APPLICATIONS

The present application is a continuation application of International Application No. PCT/JP2019/013713 filed on Mar. 28, 2019, which claims priority to Japanese Patent Application No. 2018-068048 filed on Mar. 30, 2018. The contents of these applications are incorporated herein by reference in their entirety.

BACKGROUND

Technical Field

The present disclosure relates to shovels as excavators.

Description of the Related Art

Conventionally, a shovel having a leveling excavation control mode where a blade edge of a bucket is moved along a design plane is known.

SUMMARY

However, the leveling excavation control mode is control to adjust the relative speed of the bucket blade edge with respect to the design plane depending on the distance between the bucket blade edge and the design plane, and there is a risk that the movement speed of the bucket blade edge moving along the design plane while retaining the distance between the bucket blade edge and the design plane cannot be appropriately controlled.

Therefore, it is desirable to provide a shovel that can control the movement of a predetermined portion of an attachment along a predetermined trajectory more appropriately.

A shovel according to an embodiment of the present invention includes a lower travelling body, an upper pivot body pivotably mounted to the lower travelling body, an attachment provided to the upper pivot body, a plurality of actuators that operate the attachment, an operation device provided to the upper pivot body, and a controller configured to, in response to an operation of the operation device in a first direction, operate the plurality of actuators to move a predetermined portion of the attachment based on position information, wherein the controller operates the plurality of the actuators in a first control mode and a second control mode based on the position information.

According to the above-stated solution, a shovel that can control the movement of a predetermined portion of an attachment along a predetermined trajectory more appropriately is provided.

DETAILED DESCRIPTION

Figure 1:
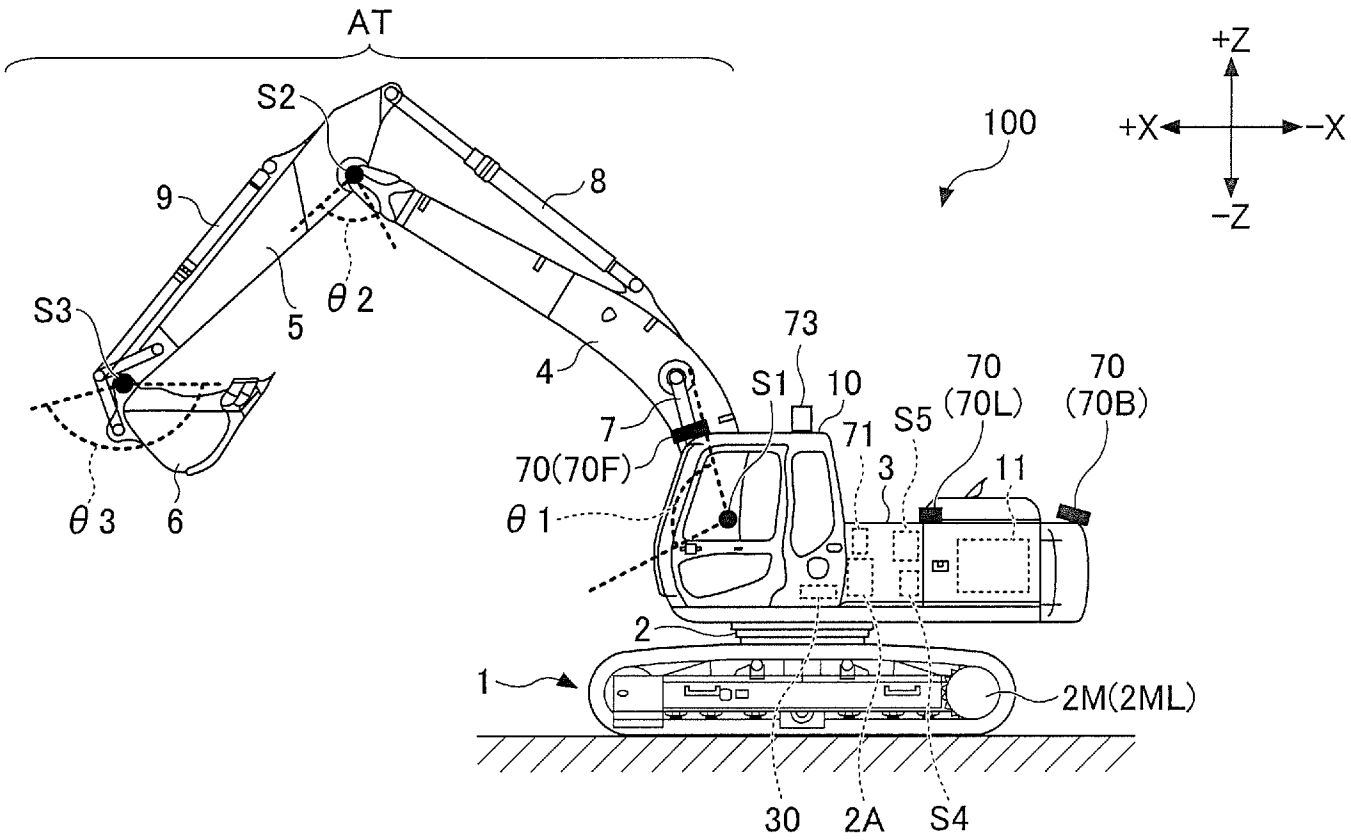
FIG. 1 is a side view of a shovel according to an embodiment of the present invention.
Figure 2:
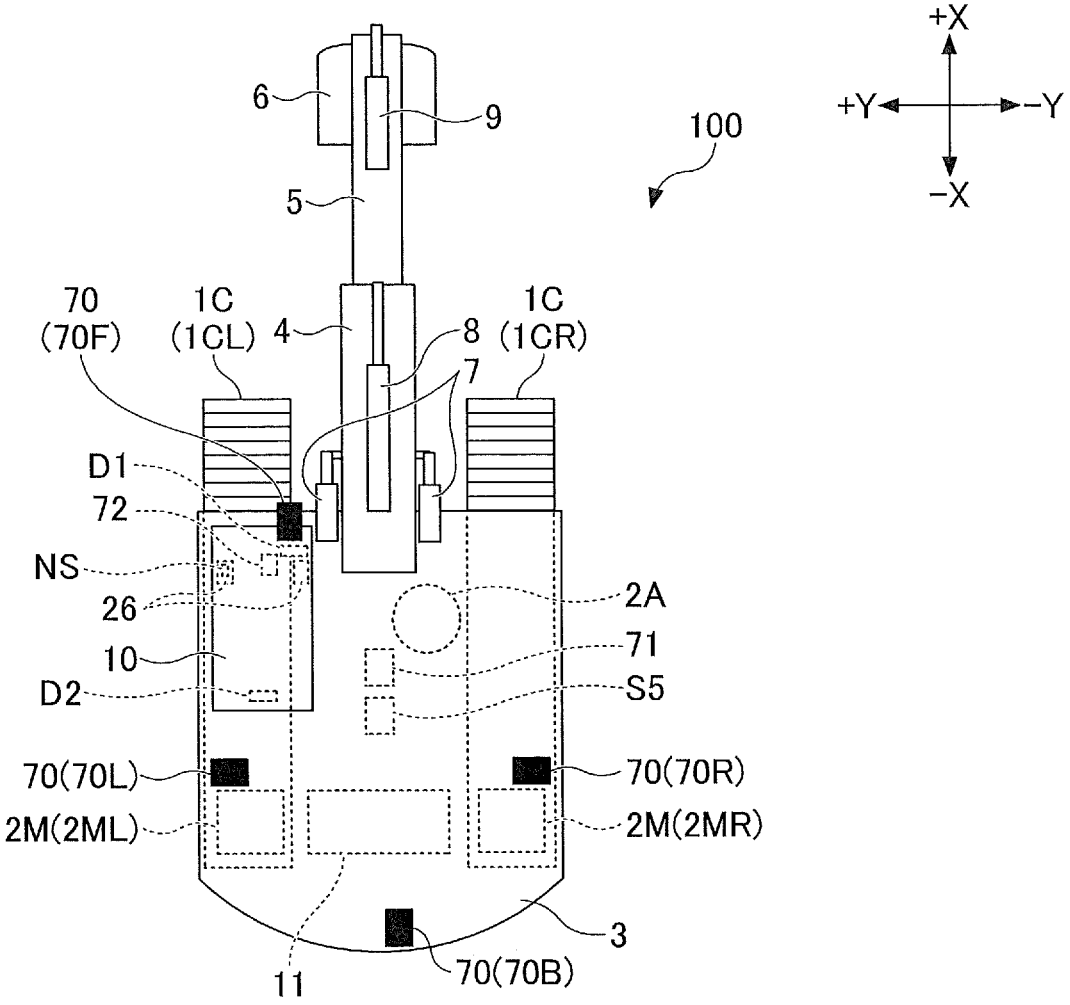
FIG. 2 is a top view of the shovel of FIG. 1.

First, a shovel 100 as an excavator according to an embodiment of the present invention is described with reference to FIGS. 1 and 2. FIG. 1 is a side view of the shovel 100, and FIG. 2 is a top view of the shovel 100.

In this embodiment, a lower travelling body 1 of the shovel 100 includes a crawler 1C. The crawler 1C is driven by a travelling hydraulic motor 2M as a travelling actuator mounted to the lower travelling body 1. Specifically, the crawler 1C includes a left crawler 1CL and a right crawler 1CR. The left crawler 1CL is driven by a left travelling hydraulic motor 2ML, and the right crawler 1CR is driven by a right travelling hydraulic motor 2MR.

An upper swiveling body 3 is pivotably mounted to the lower travelling body 1 through a pivot mechanism 2. The pivot mechanism 2 is driven by a pivot hydraulic motor 2A as a pivot actuator mounted to the upper pivot body 3. However, the pivot actuator may be a pivot motor generator as an electric actuator.

A boom 4 is mounted to the upper pivot body 3. An arm 5 is attached to the tip of the boom 4, and a bucket 6 as an end attachment is attached to the tip of the arm 5. The boom 4, the arm 5, and the bucket 6 compose an excavation attachment AT, which is one exemplary attachment. The boom 4 is driven by a boom cylinder 7, the arm 5 is driven by an arm cylinder 8, and the bucket 6 is driven by a bucket cylinder 9. The boom cylinder 7, the arm cylinder 8, and the bucket cylinder 9 compose an attachment actuator.

The boom 4 is rotatably supported up and down with respect to the upper pivot body 3. Then, a boom angle sensor S1 is mounted to the boom 4. The boom angle sensor S1 can detect the boom angle θ1, which is the rotation angle of the boom 4. The boom angle θ1 may be, for example, the raised angle from the state where the boom 4 is most lowered. Therefore, the boom angle θ1 is maximized when the boom 4 is most raised.

The arm 5 is pivotally supported relative to the boom 4. Then, an arm angle sensor S2 is mounted to the arm 5. The arm angle sensor S2 can detect the arm angle θ2, which is the rotation angle of the arm 5. The arm angle θ2 may be, for example, an opening angle from the state where the arm 5 is most closed. Therefore, the arm angle θ2 is maximized when the arm 5 is most opened.

The bucket 6 is rotatably supported relative to the arm 5. Then, a bucket angle sensor S3 is mounted to the bucket 6. The bucket angle sensor S3 can detect the bucket angle θ3, which is the rotation angle of the bucket 6. The bucket angle θ3 is the opening angle from the most closed state of the bucket 6. Therefore, the bucket angle θ3 is maximized when the bucket 6 is most opened.

In the embodiment of FIG. 1, the boom angle sensor S1, the arm angle sensor S2, and the bucket angle sensor S3 each includes a combination of an acceleration sensor and a gyro sensor. However, it may be composed of only an acceleration sensor. Also, the boom angle sensor S1 may be a stroke sensor, a rotary encoder, a potentiometer, an inertia measuring device, or the like mounted to the boom cylinder 7. The same applies to the arm angle sensor S2 and the bucket angle sensor S3.

A cabin 10 is provided to the upper pivot body 3 as an operator's cab, and a power source such as an engine 11 is mounted therein. Also, a space recognition device 70, an orientation detection device 71, a positioning device 73, a body tilt sensor S4, and a pivot angular velocity sensor S5 are mounted to the upper pivot body 3. An operation device 26, a controller 30, an information input device 72, a display device D1, a sound output device D2, or the like are mounted in the cabin 10. For convenience, it is assumed in the specification that the side where the excavation attachment AT is mounted in the upper pivot body 3 is the front side and the side where a counterweight is mounted is the rear side.

The space recognition device 70 is configured to recognize an object existing in the three-dimensional space around the shovel 100. Also, the space recognition device 70 may be configured to calculate the distance from the space recognition device 70 or the shovel 100 to the recognized object. The space recognition device 70 may include, for example, an ultrasonic sensor, a millimeter wave radar, a monocular camera, a stereo camera, a LIDAR, a distance image sensor, an infrared sensor, and the like. In this embodiment, the space recognition device 70 includes a front sensor 70F mounted to the top end of the front surface of the cabin 10, a rear sensor 70B mounted to the rear end of the top surface of the upper pivot body 3, a left sensor 70L mounted to the left end of the top surface of the upper pivot body 3, and a right sensor 70R mounted to the right end of the top surface of the upper pivot body 3. An upper sensor for recognizing an object existing in the space above the upper pivot body 3 may be attached to the shovel 100.

The orientation detection device 71 is configured to detect information regarding the relative relationship between the orientation of the upper pivot body 3 and the orientation of the lower travelling body 1. The orientation detection device 71 may be composed of, for example, a combination of a geomagnetic sensor mounted to the lower travelling body 1 and a geomagnetic sensor mounted to the upper pivot body 3. Alternatively, the orientation detection device 71 may be composed of, for example, a combination of a GNSS receiver mounted to the lower travelling body 1 and a GNSS receiver mounted to the upper pivot body 3. The orientation detection device 71 may be a rotary encoder, a rotary position sensor, or the like. In the arrangement in which the upper pivot body 3 is pivotably driven by a pivot electric generator, the orientation detection device 71 may be composed of a resolver. The orientation detection device 71 may be mounted, for example, to a center joint disposed in connection with the pivot mechanism 2 for implementing the relative rotation between the lower travelling body 1 and the upper pivot body 3. The orientation detection device 71 may be composed of a camera mounted to the upper pivot body 3. In this case, the orientation detection device 71 performs known image processing on an image (input image) captured by the camera mounted to the upper pivot body 3 to detect an image of the lower travelling body 1 included in the input image. Then, the orientation detection device 71 identifies the longitudinal direction of the lower travelling body 1 by detecting the image of the lower travelling body 1 using a known image recognition technique. Then, an angle formed between the direction of the front-rear axis of the upper pivot body 3 and the longitudinal direction of the lower travelling body 1 is derived. The direction of the front-rear axis of the upper pivot body 3 can be derived from the installation position of the camera. In particular, since the crawler 1C protrudes from the upper pivot body 3, the orientation detection device 71 can determine the longitudinal direction of the lower travelling body 1 by detecting an image of the crawler 1C. In this case, the orientation detection device 71 may be integrated with the controller 30.

The information input device 72 is configured so that an operator of the shovel can input information to the controller 30. In this embodiment, the information input device 72 is a switch panel located adjacent to a display unit of the display device D1. However, the information input device 72 may be a touch panel disposed on the display portion of the display device D1 or a sound input device such as a microphone disposed in the cabin 10.

The positioning device 73 is configured to measure the position of the upper pivot body 3. In this embodiment, the positioning device 73 is a GNSS receiver to detect the position of the upper pivot body 3 and output a detected value to the controller 30. The positioning device 73 may be a GNSS compass. In this case, the positioning device 73 can detect the position and orientation of the upper pivot body 3.

The body tilt sensor S4 detects the tilt of the upper pivot body 3 relative to a predetermined plane. In this embodiment, the body tilt sensor S4 is an acceleration sensor to detect a tilt angle about the front-rear axis of the upper pivot body 3 with respect to the horizontal plane and a tilt angle about the right-left axis. The front-rear axis and the left-right axis of the upper pivot body 3 pass through a shovel center point, which is one point on the pivot axis of the shovel 100 perpendicular to each other, for example.

The pivot angular velocity sensor S5 detects the pivot angular velocity of the upper pivot body 3. In this embodiment, it is a gyro sensor. It may be a resolver, a rotary encoder, or the like. The pivot angular velocity sensor S5 may detect the pivot velocity. The pivot velocity may be calculated from the pivot angular velocity.

Hereinafter, at least one of the boom angle sensor S1, the arm angle sensor S2, the bucket angle sensor S3, the body tilt sensor S4, and the pivot angular velocity sensor S5 is also referred to as a posture detection device. The posture of an excavation attachment AT may be detected, for example, based on respective outputs of the boom angle sensor S1, the arm angle sensor S2 and the bucket angle sensor S3.

The display device D1 is a device for displaying information. In this embodiment, the display device D1 is a liquid crystal display installed in cabin 10. However, the display device D1 may be a display of a portable terminal such as a smartphone.

The sound output device D2 is a device to output sound. The sound output device D2 includes at least one of a device for outputting sound to an operator in the cabin 10 and a device for outputting sound to a worker outside the cabin 10. It may be a speaker of a portable terminal.

The operation device 26 is a device used by an operator for operations of an actuator.

The controller 30 is a controller for controlling the shovel 100. In this embodiment, the controller 30 is composed of a computer including a CPU, a volatile storage device, a non-volatile storage device, and the like. Then, the controller 30 reads programs corresponding to respective functions from the non-volatile storage device and loads the programs to the volatile storage device to cause the CPU to perform the corresponding operations. The functions may include, for example, a machine guidance function for guiding operator's manual operations of the shovel 100 and a machine control function for supporting the operator's manual operations of the shovel 100 or causing the shovel 100 to operate automatically or autonomously.

Figure 3:
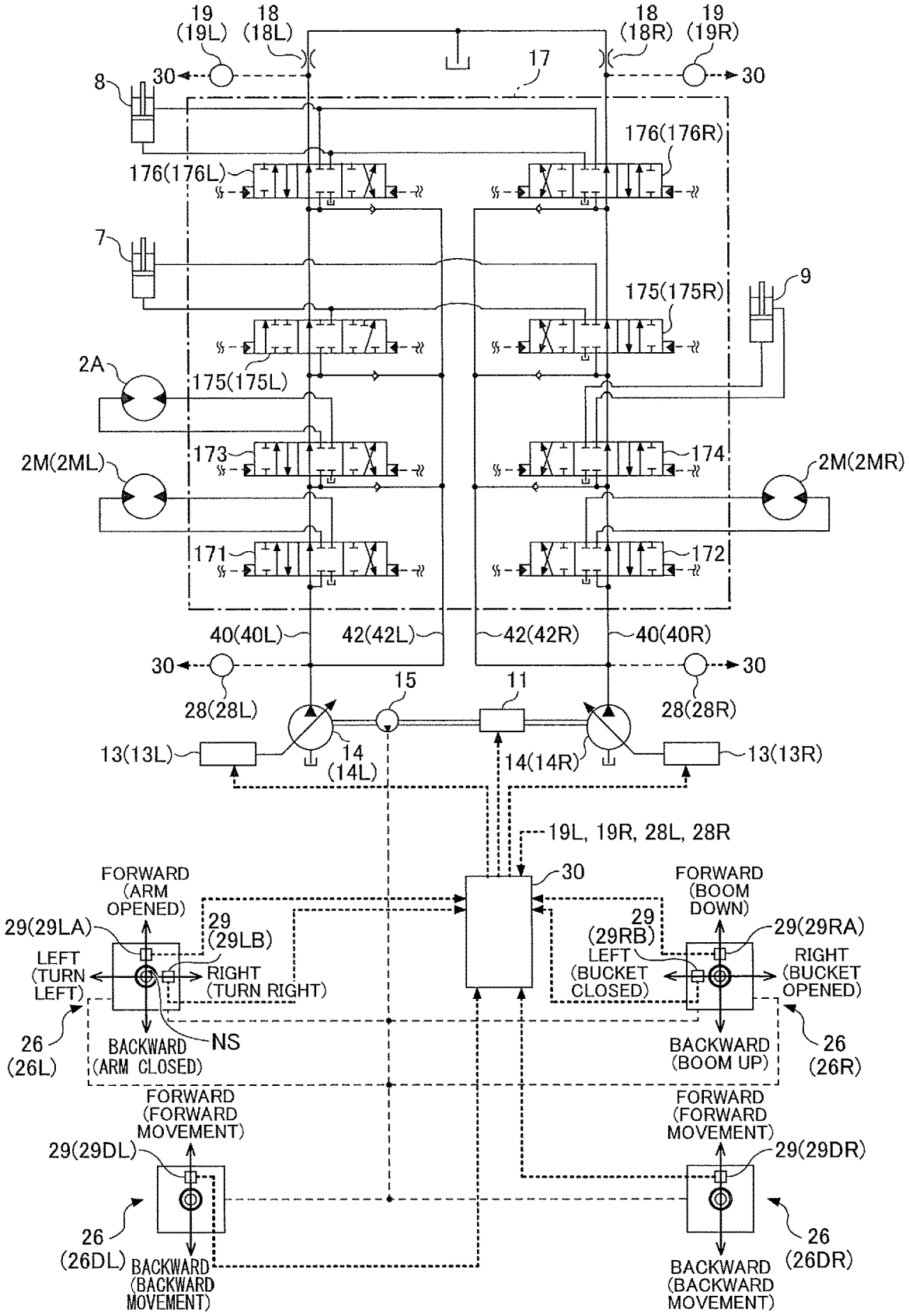
FIG. 3 is a diagram for illustrating an exemplary arrangement of a hydraulic system mounted to the shovel in FIG. 1.

Next, an exemplary arrangement of a hydraulic system mounted to the shovel 100 is described with reference to FIG. 3. FIG. 3 is a diagram for illustrating an exemplary arrangement of the hydraulic system mounted to the shovel 100. FIG. 3 shows a mechanical power transmission system, a hydraulic oil line, a pilot line and an electric control system with a double line, a solid line, a dashed line and a dotted line, respectively.

The hydraulic system of the shovel 100 mainly includes an engine 11, a regulator 13, a main pump 14, a pilot pump 15, a control valve 17, an operation device 26, a discharge pressure sensor 28, an operation pressure sensor 29, a controller 30, and the like.

In FIG. 3, the hydraulic system is configured to circulate the hydraulic oil from the main pump 14 driven by the engine 11 to the hydraulic oil tank via a center bypass line 40 or a parallel line 42.

The engine 11 is a driving source of the shovel 100. In this embodiment, the engine 11 may be, for example, a diesel engine for operating to retain a predetermined number of rotations. The output shaft of the engine 11 is coupled to the input shaft of the main pump 14 and the pilot pump 15.

The main pump 14 is configured to supply the hydraulic oil to the control valve 17 via a hydraulic oil line. In this embodiment, the main pump 14 is a swashplate variable capacity type of hydraulic pump.

The regulator 13 is configured to control the discharge amount of the main pump 14. In this embodiment, the regulator 13 controls the discharge amount of the main pump 14 by adjusting the swashplate tilt angle of the main pump 14 in response to a control command from the controller 30.

The pilot pump 15 is configured to supply the hydraulic oil to a hydraulic control device including the operation device 26 through a pilot line. In this embodiment, the pilot pump 15 is a fixed capacity type of hydraulic pump. However, the pilot pump 15 may be omitted. In this case, the function performed by the pilot pump 15 may be implemented by the main pump 14. Namely, the main pump 14 may include a function of supplying the hydraulic oil to the operation device 26 or the like after reduction in the pressure of the hydraulic oil with a throttle or the like separately from a function of supplying the hydraulic oil to the control valve 17.

The control valve 17 is a hydraulic controller for controlling the hydraulic system in the shovel 100. In this embodiment, the control valve 17 includes control valves 171 to 176. The control valve 175 includes control valve 175L and control valve 175R, and the control valve 176 includes control valves 176L and 1756. The control valve 17 is configured to selectively supply the hydraulic oil discharged by the main pump 14 to one or more hydraulic actuators through the control valves 171 to 176. The control valves 171 to 176 may control, for example, the flow amount of the hydraulic oil flowing from the main pump 14 to the hydraulic actuator and the flow amount of the hydraulic oil flowing from the hydraulic actuator to the hydraulic oil tank. The hydraulic actuator include the boom cylinder 7, the arm cylinder 8, the bucket cylinder 9, the left travelling hydraulic motor 2ML, the right travelling hydraulic motor 2MR, and the pivot hydraulic motor 2A.

The operation device 26 is a device used by an operator to operate an actuator. The operation device 26 may include, for example, an operation lever and an operation pedal. The actuator includes at least one of a hydraulic actuator and an electric actuator. In this embodiment, the operation device 26 is configured to supply the hydraulic oil discharged by the pilot pump 15 to a pilot port of the corresponding control valve in the control valve 17 via a pilot line. The pressure (pilot pressure) of the hydraulic oil supplied to each of the pilot ports is the pressure corresponding to the operation direction and the operation amount of the operation device 26 corresponding to each of the hydraulic actuators. However, the operation device 26 may be of an electric control type rather than a pilot pressure type as described above. In this case, the control valve in the control valve 17 may be a solenoid spool valve.

The discharge pressure sensor 28 is configured to detect the discharge pressure of the main pump 14. In this embodiment, the discharge pressure sensor 28 outputs a detected value to the controller 30.

The operation pressure sensor 29 is configured to detect operational contents of the operation device 26 by an operator. In this embodiment, the operation pressure sensor 29 detects the operation direction and the operation amount of the operation device 26 corresponding to each of the actuators in the form of pressure (operation pressure) and outputs the detected value to the controller 30. The operational contents of the operation device 26 may be detected using other sensors other than the operation pressure sensor.

The main pump 14 includes a left main pump 14L and a right main pump 14R. Then, the left main pump 14L circulates the hydraulic oil to the hydraulic oil tank through the left center bypass line 40L or the left parallel line 42L, and the right main pump 14R circulates the hydraulic oil to the hydraulic oil tank through the right center bypass line 40R or the right parallel line 42R.

The left center bypass line 40L is a hydraulic oil line for passing through the control valves 171, 173, 175L and 176L disposed in the control valve 17. The right center bypass line 40R is a hydraulic oil line for passing through the control valves 172, 174, 175R and 176R disposed in the control valve 17.

The control valve 171 is a spool valve for feeding the hydraulic oil discharged by the left main pump 14L to the left travelling hydraulic motor 2ML and switching the flow of the hydraulic oil to discharge the hydraulic oil discharged by the left travelling hydraulic motor 2ML to the hydraulic oil tank.

The control valve 172 is a spool valve for feeding the hydraulic oil discharged by the right main pump 14R to the right travelling hydraulic motor 2MR and switching the flow of the hydraulic oil to discharge the hydraulic oil discharged by the right travelling hydraulic motor 2MR to the hydraulic oil tank.

The control valve 173 is a spool valve for supplying the hydraulic oil discharged by the left main pump 14L to the pivot hydraulic motor 2A and switching the flow of the hydraulic oil to discharge the hydraulic oil discharged by the pivot hydraulic motor 2A to the hydraulic oil tank.

The control valve 174 is a spool valve for feeding the hydraulic oil discharged by the right main pump 14R to the bucket cylinder 9 and switching the flow of the hydraulic oil to discharge the hydraulic oil in the bucket cylinder 9 to the hydraulic oil tank.

The control valve 175L is a spool valve for switching the flow of the hydraulic oil to supply the hydraulic oil discharged by the left main pump 14L to the boom cylinder 7. The control valve 175R is a spool valve for feeding the hydraulic oil discharged by the right main pump 14R to the boom cylinder 7 and switching the flow of the hydraulic oil to discharge the hydraulic oil in the boom cylinder 7 to the hydraulic oil tank.

The control valve 176L is a spool valve for feeding the hydraulic oil discharged by the left main pump 14L to the arm cylinder 8 and switching the flow of the hydraulic oil to discharge the hydraulic oil in the arm cylinder 8 to the hydraulic oil tank.

The control valve 176R is a spool valve for feeding the hydraulic oil discharged by the right main pump 14R to the arm cylinder 8 and switching the flow of the hydraulic oil to discharge the hydraulic oil in the arm cylinder 8 to the hydraulic oil tank.

The left parallel line 42L is a hydraulic oil line parallel to the left center bypass line 40L. If the flow of the hydraulic oil passing through the left center bypass line 40L is limited or interrupted by any of the control valves 171, 173 and 175L, the left parallel line 42L can supply the hydraulic oil to a downstream control valve. The right parallel line 42R is a hydraulic oil line parallel to the right center bypass line 40R. If the flow of the hydraulic oil passing through the right center bypass line 40R is limited or interrupted by any of the control valves 172, 174 and 175R, the right parallel line 42R can supply the hydraulic oil to a downstream control valve.

The regulator 13 includes a left regulator 13L and a right regulator 13R. The left regulator 13L controls the discharge amount of the left main pump 14L by adjusting the swashplate tilt angle of the left main pump 14L in accordance with increasing the discharge pressure of the left main pump 14L. Specifically, the left regulator 13L adjusts the swashplate tilt angle of the left main pump 14L in accordance with increasing the discharge pressure of the left main pump 14L to reduce the discharge amount, for example. The same applies to the right regulator 13R. This is to avoid the absorbed horsepower of the main pump 14, which is expressed as the product of the discharge pressure and the discharge amount, exceeding the output horsepower of the engine 11.

The operation device 26 includes a left operation lever 26L, a right operation lever 26R and a travelling lever 26D. The travelling lever 26D includes a left travelling lever 26DL and a right travelling lever 26DR.

The left operation lever 26L is used for the rotation operation and the operation of the arm 5. The left operation lever 26L, when it is operated in a forward-backward direction, utilizes the hydraulic oil discharged by the pilot pump 15 to introduce the control pressure corresponding to the lever operation amount into the pilot port of the control valve 176. Also, when it is operated in the right-left direction, the left operation lever 26L utilizes the hydraulic oil discharged by the pilot pump 15 to introduce the control pressure corresponding to the lever operation amount into the pilot port of the control valve 173.

Specifically, when it is operated in the arm closing direction, the left operation lever 26L introduces the hydraulic oil to the right pilot port of the control valve 176L and introduces the hydraulic oil to the left pilot port of the control valve 176R. Also, the left operation lever 26L, when it is operated in the arm opening direction, introduces the hydraulic oil to the left pilot port of the control valve 176L and introduces the hydraulic oil to the right pilot port of the control valve 176R. Also, when it is operated in the left pivot direction, the left operation lever 26L introduces the hydraulic oil to the left pilot port of the control valve 173 and when it is operated in the right pivot direction, introduces the hydraulic oil to the right pilot port of the control valve 173.

The right operation lever 26R is used to operate the boom 4 and the bucket 6. The right operation lever 26R, when it is operated in the forward-backward direction, utilizes the hydraulic oil discharged by the pilot pump 15 to introduce the control pressure corresponding to the lever operation amount into the pilot port of the control valve 175. Also, when it is operated in the right-left direction, the right operation lever 26R utilizes the hydraulic oil discharged by the pilot pump 15 to introduce the control pressure corresponding to the lever operation amount into the pilot port of the control valve 174.

Specifically, the right operation lever 26R, when it is operated in the boom down direction, introduces the hydraulic oil to the left pilot port of the control valve 175R. Also, the right operation lever 26R, when it is operated in the boom up direction, introduces the hydraulic oil to the right pilot port of the control valve 175L and introduces the hydraulic oil to the left pilot port of the control valve 175R. Also, the right operation lever 26R, when it is operated in the bucket closing direction, introduces the hydraulic oil to the right pilot port of the control valve 174 and when it is operated in the bucket opening direction, introduces the hydraulic oil to the left pilot port of the control valve 174.

The travelling lever 26D is used to operate the crawler 1C. Specifically, the left travelling lever 26DL is used to operate the left crawler 1CL. It may be configured to interlock with the left travelling pedal. The left travelling lever 26DL, when it is operated in the forward-backward direction, utilizes the hydraulic oil discharged by the pilot pump 15 to introduce the control pressure corresponding to the lever operation amount into the pilot port of the control valve 171. The right travelling lever 26DR is used to operate the right crawler 1CR. It may be configured to interlock with the right travelling pedal. The right travelling lever 26DR, when it is operated in the forward-backward direction, utilizes the hydraulic oil discharged by the pilot pump 15 to introduce the control pressure corresponding to the lever operation amount into the pilot port of the control valve 172.

The discharge pressure sensor 28 includes a discharge pressure sensor 28L and a discharge pressure sensor 28R. The discharge pressure sensor 28L detects the discharge pressure of the left main pump 14L and outputs a detected value to the controller 30. The same applies to the discharge pressure sensor 28R.

The operation pressure sensor 29 includes operation pressure sensors 29LA, 29LB, 29RA, 29RB, 29DL and 29DR. The operation pressure sensor 29LA detects operational contents of the left operation lever 26L in the forward-backward direction by the operator in the form of pressure and outputs a detected value to the controller 30. The operational contents may be, for example, the lever operation direction, the lever operation amount (lever operation angle) or the like.

Similarly, the operation pressure sensor 29LB detects operational contents of the left operation lever 26L in the left-right direction by the operator in the form of pressure and outputs a detected value to the controller 30. The operation pressure sensor 29RA detects operational contents of the right operation lever 26R in the forward-backward direction by the operator in the form of pressure and outputs a detected value to the controller 30. The operation pressure sensor 29RB detects operational contents of the right operation lever 26R in the left-right direction by the operator in the form of pressure and outputs a detected value to the controller 30. The operation pressure sensor 29DL detects operational contents of the left running lever 26DL in the forward-backward direction by the operator in the form of pressure and outputs a detected value to the controller 30. The operation pressure sensor 29DR detects operational contents of the right travelling lever 26DR in the forward-backward direction by the operator in the form of pressure and outputs a detected value to the controller 30.

The controller 30 receives an output of the operation pressure sensor 29 and outputs a control command to the regulator 13 as needed to change the discharge amount of the main pump 14. Also, the controller 30 receives an output of the control pressure sensor 19 provided in the upstream of the throttle 1 and outputs a control command to the regulator 13 as necessary to change the discharge amount of the main pump 14. The throttle 18 includes a left throttle 18L and a right throttle 18R, and the control pressure sensor 19 includes a left control pressure sensor 19L and a right control pressure sensor 19R.

In the left center bypass line 40L, a left throttle 18L is disposed between the control valve 176L, which is in the most downstream, and the hydraulic oil tank. Therefore, the flow of the hydraulic oil discharged by the left main pump 14L is limited by the left diaphragm 18L. Then, the left throttle 18L generates a control pressure for controlling the left regulator 13L. The left control pressure sensor 19L is a sensor for detecting the control pressure and outputting a detected value to the controller 30. The controller 30 controls the discharge amount of the left main pump 14L by adjusting the swashplate tilt angle of the left main pump 14L depending on the control pressure. The controller 30 decreases the discharge amount of the left main pump 14L as the control pressure is higher, and increases the discharge amount of the left main pump 14L as the control pressure is lower. The discharge amount of the right main pump 14R is similarly controlled.

Specifically, if none of the hydraulic actuators in the shovel 100 is in the non-operated standby state as shown in FIG. 3, the hydraulic oil discharged by the left main pump 14L passes through the left center bypass line 40L toward the left throttle 18L. Then, the flow of the hydraulic oil discharged by the left main pump 14L increases the control pressure generated in the upstream of the left throttle 18L. As a result, the controller 30 reduces the discharge amount of the left main pump 14L to an allowable minimum discharge amount and suppresses the pressure loss (pumping loss) at passage of the discharged hydraulic oil through the left center bypass line 40L. On the other hand, if any of the hydraulic actuators is operated, the hydraulic oil discharged by the left main pump 14L flows into a to-be-operated hydraulic actuator through a control valve corresponding to the to-be-operated hydraulic actuator. Then, the flow of the hydraulic oil discharged by the left main pump 14L decreases or disappears the amount reaching the left throttle 18L, thereby lowering the control pressure generated in the upstream of the left throttle 18L. As a result, the controller 30 increases the discharge amount of the left main pump 14L to circulate a sufficient amount of the hydraulic oil to the to-be-operated hydraulic actuator to ensure driving of the to-be-operated hydraulic actuator. Note that the controller 30 controls the discharge amount of the right main pump 14R in the same manner.

According to the above-stated arrangement, the hydraulic system of FIG. 3 can reduce wasted energy consumption at the main pump 14 in the standby state. The wasteful energy consumption includes a pumping loss caused by the hydraulic oil discharged by the main pump 14 in the center bypass line 40. Also, the hydraulic system of FIG. 3, when the hydraulic actuator is operated, ensures that a necessary and sufficient amount of the hydraulic oil can be supplied from the main pump 14 to the to-be-operated hydraulic actuator.

Figure 4A:
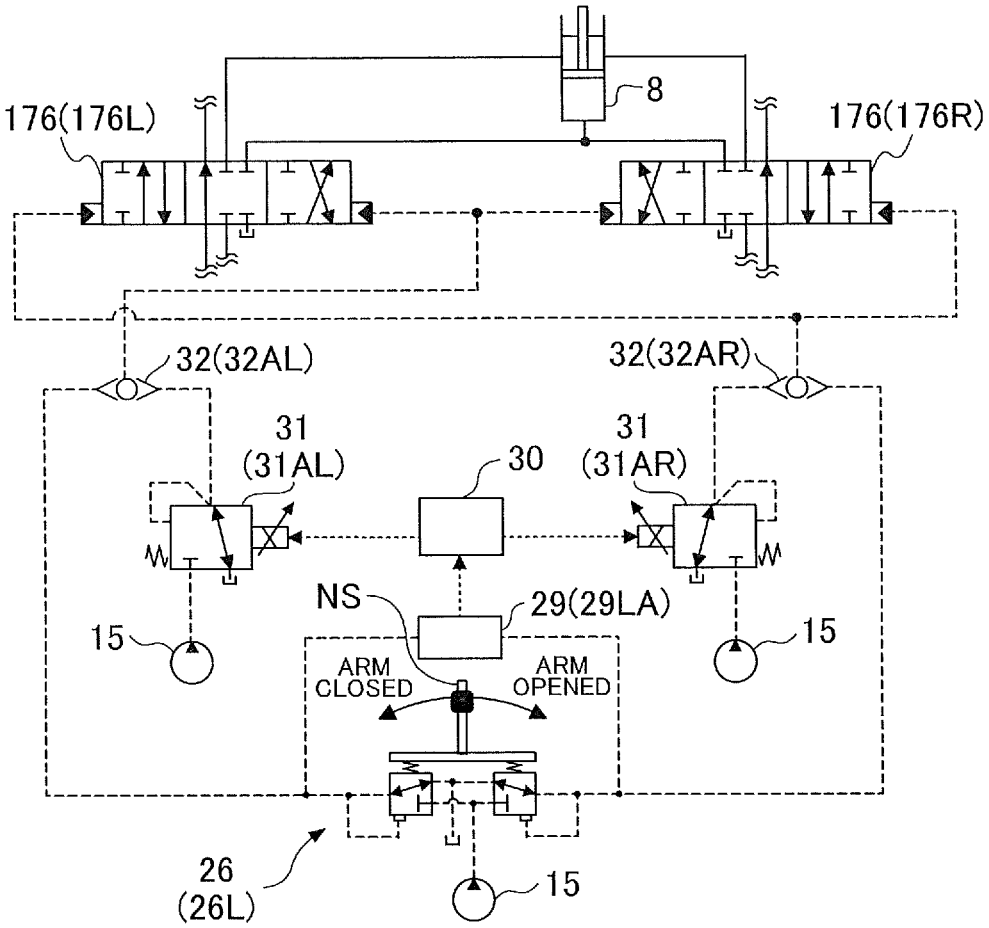
FIG. 4A is a view of a portion of a hydraulic system related to operations of an arm cylinder.
Figure 4B:
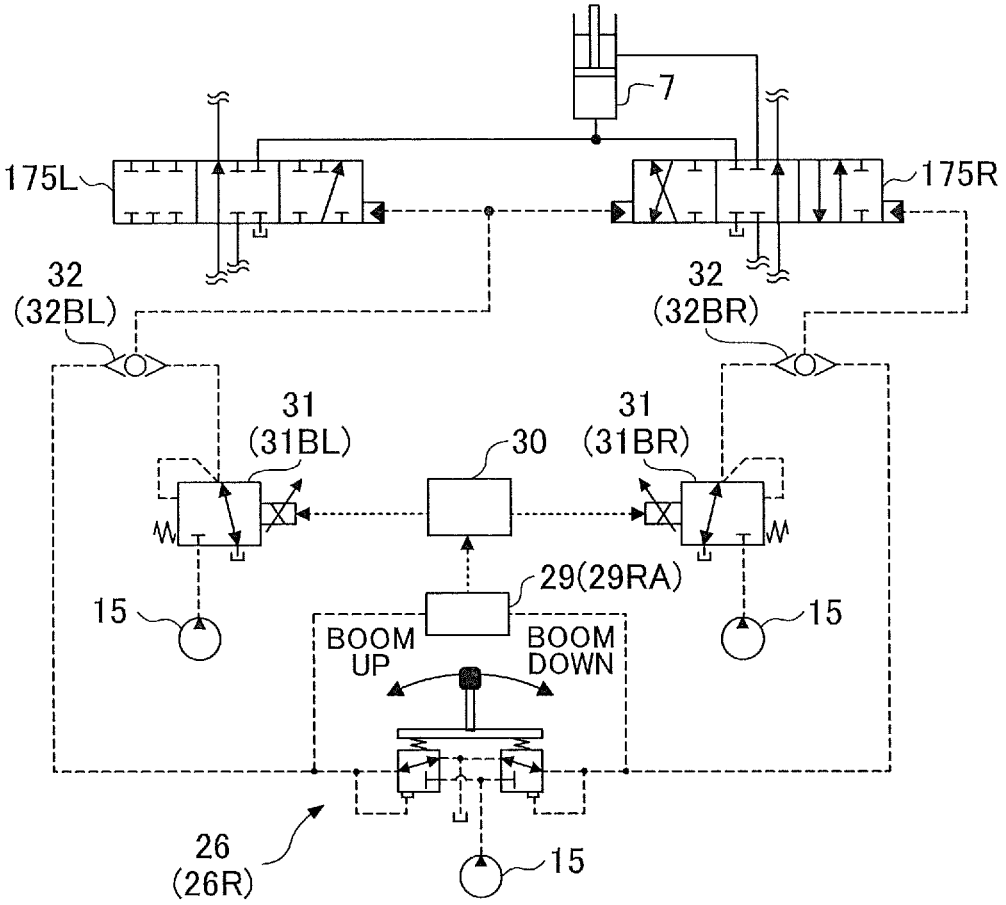
FIG. 4B is a view of a portion of a hydraulic system related to operations of a boom cylinder.
Figure 4C:
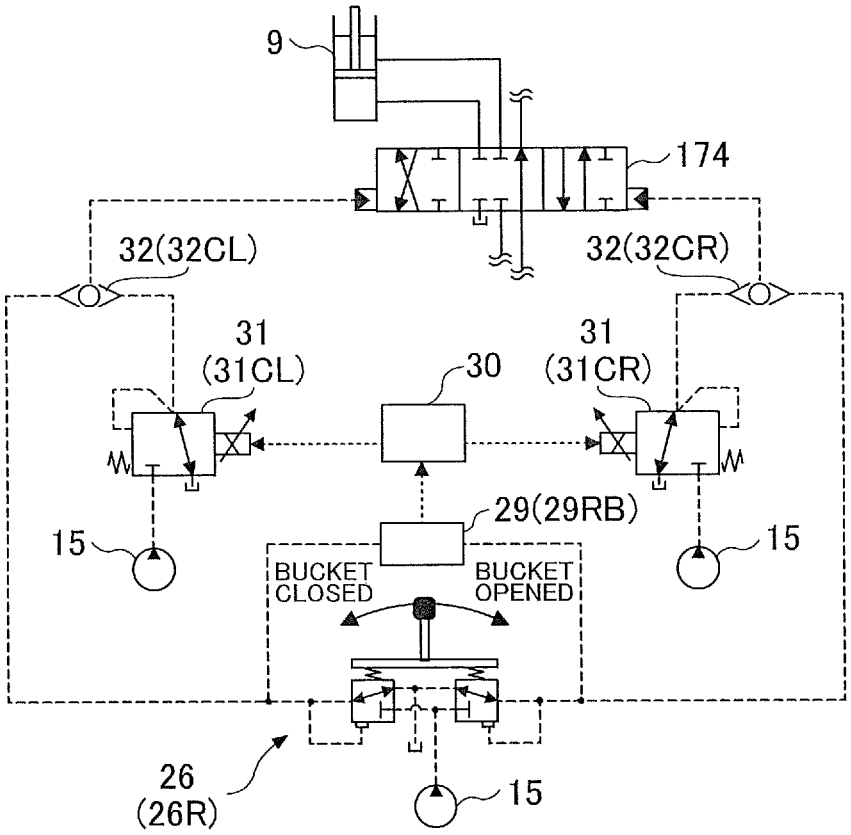
FIG. 4C is a view of a portion of a hydraulic system related to operation of a bucket cylinder.
Figure 4D:
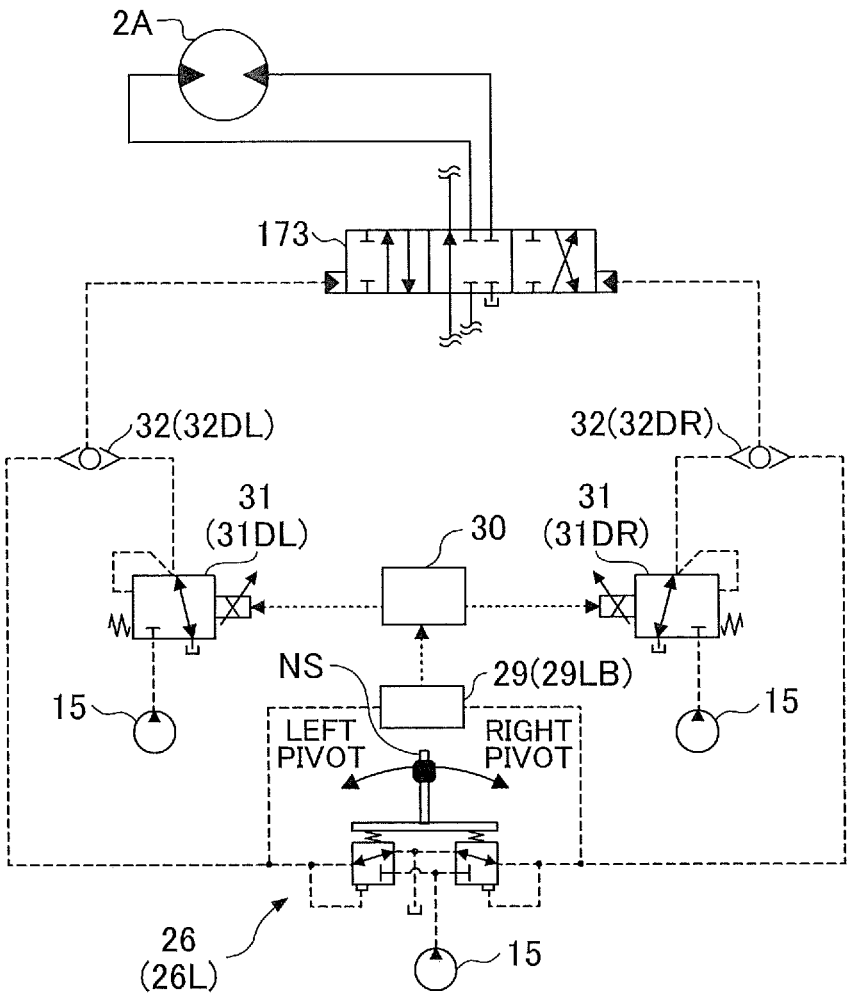
FIG. 4D is a view of a portion of a hydraulic system related to operation of a pivot hydraulic motor.

Next, an arrangement of the controller 30 causing an actuator to operate by means of a machine control function is described with reference to FIGS. 4A to 4D. FIGS. 4A to 4D are views of portions of a hydraulic system. Specifically, FIG. 4A is a view of a portion of the hydraulic system related to operations of the arm cylinder 8, and FIG. 4B is a view of a portion of the hydraulic system related to operations of the boom cylinder 7. FIG. 4C is a view of a portion of the hydraulic system related to operations of the bucket cylinder 9, and FIG. 4D is a view of a portion of the hydraulic system related to operations of the pivot hydraulic motor 2A.

As shown in FIGS. 4A to 4D, the hydraulic system includes a proportional valve 31 and a shuttle valve 32. The proportional valve 31 includes proportional valves 31AL to 31DL and 31AR to 31DR, and the shuttle valve 32 includes shuttle valves 32AL to 32DL and 32AR to 32DR.

The proportional valve 31 functions as a control valve for machine control. The proportional valve 31 is disposed in a conduit for coupling the pilot pump 15 with the shuttle valve 32 and is configured to change the flow area of the conduit. In this embodiment, the proportional valve 31 operates in response to a control command fed from the controller 30. Thus, the controller 30 can supply the hydraulic oil discharged by the pilot pump 15 to the pilot port of the corresponding control valve in the control valve 17 via the proportional valve 31 and the shuttle valve 32, regardless of operator's operations of the operation device 26.

The shuttle valve 32 includes two inlet ports and one outlet port. One of the two inlet ports is coupled to the operation device 26, and the other is coupled to the proportional valve 31. The outlet port is coupled to a pilot port of the corresponding control valve in control valve 17. Thus, the shuttle valve 32 can cause the higher of the pilot pressure generated by the operation device 26 and the pilot pressure generated by the proportional valve 31 to be applied to the corresponding pilot port of the control valve.

According to this arrangement, even if no operation is performed on the particular operation device 26, the controller 30 can operate a hydraulic actuator corresponding to the particular operation device 26.

For example, as shown in FIG. 4A, the left operation lever 26L is used to operate the arm 5. Specifically, the left operation lever 26L utilizes the hydraulic oil discharged by the pilot pump 15 to apply the pilot pressure corresponding to operations in the forward-backward direction to the pilot port of the control valve 176. More specifically, the left operation lever 26L, if it is operated in the arm closing direction (backward direction), applies the pilot pressure corresponding to the operation amount to the right pilot port of the control valve 176L and the left pilot port of the control valve 176R. Also, if the left operation lever 26L is operated in the arm opening direction (forward direction), the left operation lever 26L applies the pilot pressure corresponding to the operation amount to the left pilot port of the control valve 176L and the right pilot port of the control valve 176R.

A switch NS is provided to the left operation lever 26L. In this embodiment, the switch NS is a push-button switch provided at the tip of the left operation lever 26L. The operator can operate the left operation lever 26L while pressing the switch NS. The switch NS may be provided to the right operation lever 26R or at other locations in the cabin 10.

The operation pressure sensor 29LA detects operational contents of the left operation lever 26L in the forward-backward direction by the operator in the form of pressure and outputs a detected value to the controller 30.

The proportional valve 31AL operates in response to a current command fed from the controller 30. Then, the pilot pressure of the hydraulic oil introduced from the pilot pump 15 to the right pilot port of the control valve 176L and the left pilot port of the control valve 176R through the proportional valve 31AL and the shuttle valve 32AL is adjusted. The proportional valve 31AR operates in response to a current command fed from the controller 30. Then, the pilot pressure of the hydraulic oil introduced from the pilot pump 15 to the left pilot port of the control valve 176L and the right pilot port of the control valve 176R through the proportional valve 31AR and the shuttle valve 32AR is adjusted. The proportional valves 31AL and 31AR can adjust the pilot pressure so that the control valves 176L and 176R can be stopped at any valve position.

According to this arrangement, the controller 30 can supply the hydraulic oil discharged by the pilot pump 15 to the right pilot port of the control valve 176L and the left pilot port of the control valve 176R through the proportional valve 31AL and the shuttle valve 32AL, regardless of the arm closing operation by the operator. Namely, the arm 5 can be closed. Also, the controller 30 may supply the hydraulic oil discharged by the pilot pump 15 to the left pilot port of the control valve 176L and the right pilot port of the control valve 176R through the proportional valve 31AR and the shuttle valve 32AR, regardless of arm opening operations by the operator. Namely, the arm 5 can be opened.

Also, as shown in FIG. 4B, the right operation lever 26R is used to operate the boom 4. Specifically, the right operation lever 26R utilizes the hydraulic oil discharged by the pilot pump 15 to apply the pilot pressure corresponding to operations in the forward-backward direction to the pilot port of the control valve 175. More specifically, the right operation lever 26R, if it is operated in the boom up direction (backward direction), applies the pilot pressure corresponding to the operation amount to the right pilot port of the control valve 175L and the left pilot port of the control valve 175R. Also, if the right operation lever 26R is operated in the boom down direction (forward direction), the right operation lever 26R applies the pilot pressure corresponding to the operation amount to the right pilot port of the control valve 175R.

The operation pressure sensor 29RA detects operational contents of the right operation lever 26R in the forward-backward direction by the operator in the form of pressure and outputs a detected value to the controller 30.

The proportional valve 31BL operates in response to a current command fed from the controller 30. Then, the pilot pressure of the hydraulic oil introduced from the pilot pump 15 into the right pilot port of the control valve 175L and the left pilot port of the control valve 175R through the proportional valve 31BL and the shuttle valve 32BL is adjusted. The proportional valve 31BR operates in response to a current command fed from the controller 30. Then, the pilot pressure of the hydraulic oil introduced from the pilot pump 15 into the left pilot port of the control valve 175L and the right pilot port of the control valve 175R through the proportional valve 31BR and the shuttle valve 32BR is adjusted. The proportional valves 31BL and 31BR can adjust the pilot pressure so that the control valves 175L and 175R can be stopped at any valve position.

According to this arrangement, the controller 30 can supply the hydraulic oil discharged by the pilot pump 15 to the right pilot port of the control valve 175L and the left pilot port of the control valve 175R through the proportional valve 31BL and the shuttle valve 32BL, regardless of operator's boom up operations. Namely, the boom 4 can be raised. Also, the controller 30 can supply the hydraulic oil discharged by the pilot pump 15 to the right pilot port of the control valve 175R through the proportional valve 31BR and the shuttle valve 32BR, regardless of operator's boom down operations. Namely, the boom 4 can be lowered.

Also, as shown in FIG. 4C, the right operation lever 26R is used to operate the bucket 6. Specifically, the right operation lever 26R utilizes the hydraulic oil discharged by the pilot pump 15 to apply the pilot pressure corresponding to operations in the right-left direction to the pilot port of the control valve 174. More specifically, the right operation lever 26R, if it is operated in the bucket closing direction (left direction), causes the pilot pressure corresponding to the operation amount to be applied to the left pilot port of the control valve 174. Also, the right operation lever 26R, if it is operated in the bucket opening direction (right direction), the right operation lever 26R causes the pilot pressure corresponding to the operation amount to be applied to the right pilot port of the control valve 174.

The operation pressure sensor 29RB detects operational contents of the right operation lever 26R in the right-left direction by the operator in the form of pressure and outputs a detected value to the controller 30.

The proportional valve 31CL operates in response to a current command fed from the controller 30. Then, the pilot pressure of the hydraulic oil introduced from the pilot pump 15 to the left pilot port of the control valve 174 through the proportional valve 31CL and the shuttle valve 32CL is adjusted. The proportional valve 31CR operates in response to a current command fed from the controller 30. Then, the pilot pressure of the hydraulic oil introduced from the pilot pump 15 to the right pilot port of the control valve 174 via the proportional valve 31CR and the shuttle valve 32CR is adjusted. The proportional valves 31CL and 31CR can adjust the pilot pressure so that the control valve 174 can be stopped at any valve position.

According to this arrangement, the controller 30 can supply the hydraulic oil discharged by the pilot pump 15 to the left pilot port of the control valve 174 via the proportional valve 31CL and the shuttle valve 32CL, regardless of operator's bucket closing operations. Namely, the bucket 6 can be closed. Also, the controller 30 can supply the hydraulic oil discharged by the pilot pump 15 to the right pilot port of the control valve 174 through the proportional valve 31CR and the shuttle valve 32CR, regardless of operator's bucket opening operations. Namely, the bucket 6 can be opened.

Also, as shown in FIG. 4D, the left operation lever 26L is used to operate the pivot mechanism 2. Specifically, the left operation lever 26L utilizes the hydraulic oil discharged by the pilot pump 15 to apply the pilot pressure corresponding to an operation in the left-right direction to the pilot port of the control valve 173. More specifically, the left operation lever 26L, if it is operated in the left pivot direction (left direction), applies the pilot pressure corresponding to the operation amount to the left pilot port of the control valve 173. Also, if the left operation lever 26L is operated in the right pivot direction (right direction), the left operation lever 26L applies the pilot pressure corresponding to the operation amount to the right pilot port of the control valve 173.

The operation pressure sensor 29LB detects operational contents of the left operation lever 26L in the left-right direction by the operator in the form of pressure and outputs a detected value to the controller 30.

The proportional valve 31DL operates in response to a current command fed from the controller 30. Then, the pilot pressure of the hydraulic oil introduced from the pilot pump 15 to the left pilot port of the control valve 173 through the proportional valve 31DL and the shuttle valve 32DL is adjusted. The proportional valve 31DR operates in response to a current command fed from the controller 30. Then, the pilot pressure of the hydraulic oil introduced from the pilot pump 15 to the right pilot port of the control valve 173 via the proportional valve 31DR and the shuttle valve 32DR is adjusted. Then, the proportional valve 31DL and 31DR can adjust the pilot pressure so that the control valve 173 can be stopped at any valve position.

According to this arrangement, the controller 30 can supply the hydraulic oil discharged by the pilot pump 15 to the left pilot port of the control valve 173 through the proportional valve 31DL and the shuttle valve 32DL, regardless of operator's left pivot operations. Namely, the pivot mechanism 2 can be pivoted in the left direction. Also, the controller 30 can supply the hydraulic oil discharged by the pilot pump 15 to the right pilot port of the control valve 173 through the proportional valve 31DR and the shuttle valve 32DR, regardless of operator's right pivot operations. Namely, the pivot mechanism 2 can be pivoted in the right direction.

The shovel 100 may be configured to automatically advance and reverse the lower travelling body 1. In this case, a hydraulic system portion related to operations, of the left travelling hydraulic motor 2ML and a hydraulic system portion related to operations of the right travelling hydraulic motor 2MR may be configured in the same manner as a hydraulic system portion related to operations of the boom cylinder 7.

Also, although a hydraulic operation system with a hydraulic pilot circuitry has been described as the implementation of the operation device 26, an electric operation system with an electric pilot circuitry rather than the hydraulic operation system may be employed. In this case, the lever operation amount of the electric operation lever in the electric operation system is input to the controller 30 as an electric signal. Also, a solenoid valve is disposed between the pilot pump 15 and the pilot ports of respective control valves. The solenoid valve is configured to operate in response to an electric signal from the controller 30. According to this arrangement, if a manual operation by means of the electric operation lever is performed, the controller 30 can control the solenoid valve by an electric signal corresponding to the lever operation amount to increase or decrease the pilot pressure so as to move the respective control valves. Note that each control valve may be composed of a solenoid spool valve. In this case, the solenoid spool valve operates in response to an electric signal from the controller 30 corresponding to the level operation amount of the electric operation lever.

Figure 5:
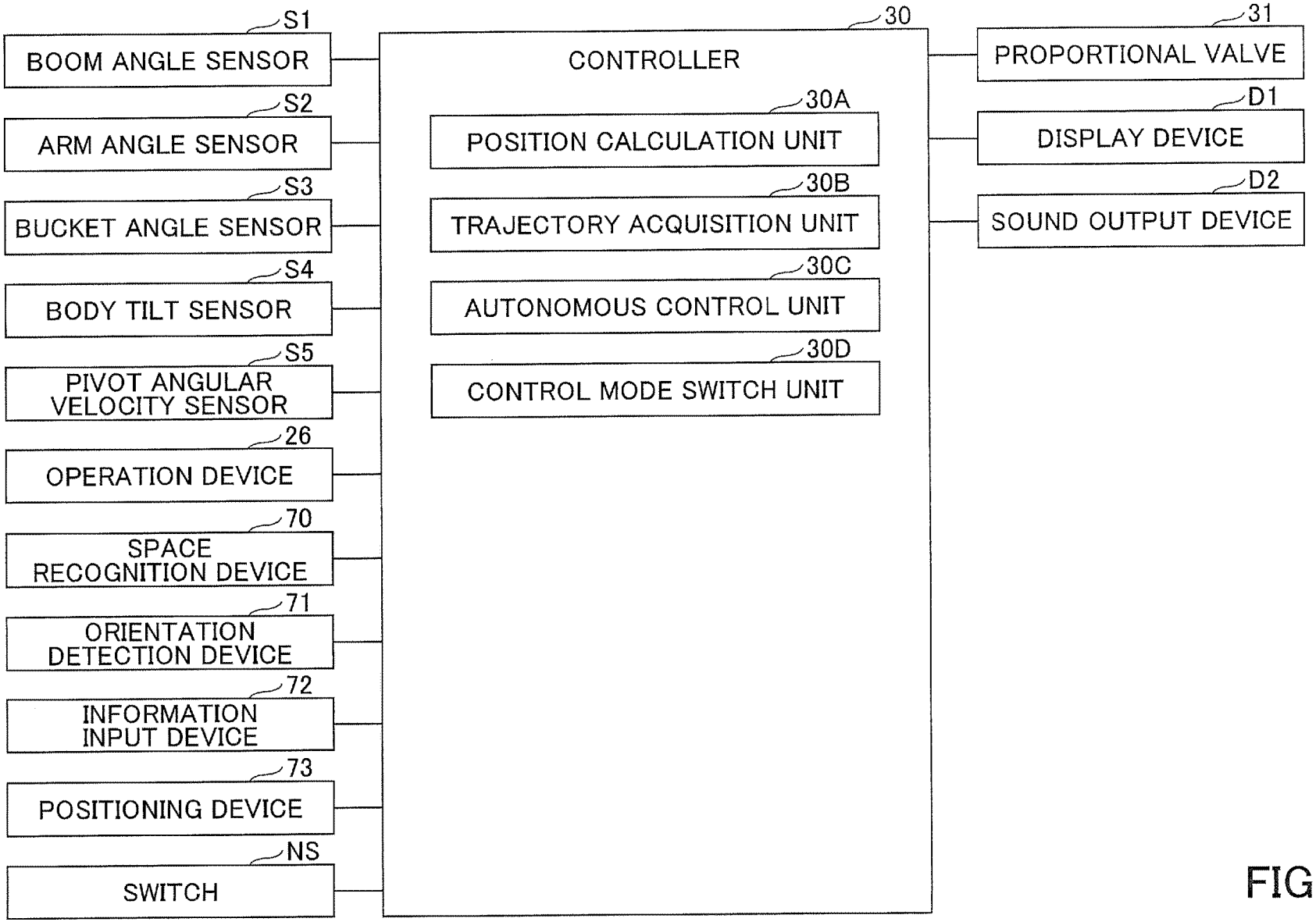
FIG. 5 is a functional block diagram of a controller.

Next, a function of the controller 30 is described with reference to FIG. 5. FIG. 5 is a functional block diagram of the controller 30. In the example of FIG. 5, the controller 30 is configured to receive signals fed from at least one of the posture detection device, the operation device 26, the space recognition device 70, the orientation detection device 71, the information input device 72, the positioning device 73, the switch NS and others, perform various operations, and output control commands to at least one of the proportional valve 31, the display device D1, the sound output device D2 and others. The posture detection device includes a boom angle sensor S1, an arm angle sensor S2, a bucket angle sensor S3, a body tilt sensor S4 and a pivot angular velocity sensor S5. The controller 30 has a position calculation unit 30A, a trajectory acquisition unit 30B, an autonomous control unit 30C and a control mode switch unit 30D as functional elements. Each functional element may be composed of hardware or software.

The position calculation unit 30A is configured to calculate the position of a to-be-positioned target. In this embodiment, the position calculation unit 30A calculates the coordinate point in a reference coordinate system of a predetermined portion of an attachment. The predetermined portion may be, for example, the claw edge of the bucket 6. The origin of the reference coordinate system may be, for example, the intersection of the pivot axis and the ground plane of the shovel 100. The position calculation unit 30A calculates the coordinate point of the claw edge of the bucket 6 from the respective rotation angles of the boom 4, the arm 5 and the bucket 6, for example. The position calculation unit 30A may calculate not only the coordinate point of the center of the claw edge of the bucket 6 but also the coordinate point of the left end of the claw edge of the bucket 6, and the coordinate point of the right end of the claw edge of the bucket 6. In this case, the position calculation unit 30A may utilize an output of the body tilt sensor S4.

The trajectory acquisition unit 30B is configured to acquire a target trajectory as a traversed trajectory of the predetermined portion of an attachment at autonomously operating the shovel 100. In this embodiment, the trajectory acquisition unit 30B acquires the target trajectory used when the autonomous control unit 30C autonomously operates the shovel 100.

Specifically, the trajectory acquisition unit 30B derives the target trajectory based on data concerning a target construction surface stored in a non-volatile storage device. The trajectory acquisition unit 30B may derive the target trajectory based on information regarding the terrain around the shovel 100 recognized by the space recognition device 70. Alternatively, the trajectory acquisition unit 30B may derive information regarding the past trajectory of the claw edge of the bucket 6 from a past output of the posture detection device stored in a volatile storage device and derive the target trajectory based on that information. Alternatively, the trajectory acquisition unit 30B may derive the target trajectory based on the current position of a predetermined portion of the attachment and the data regarding the target construction plane.

The autonomous control unit 30C is configured to operate the shovel 100 autonomously. In this embodiment, if a predetermined activation condition is satisfied, the autonomous control unit 30C is configured to move a predetermined portion of the attachment along the target trajectory acquired by the trajectory acquisition unit 30B. Specifically, when the operation device 26 is operated while the switch NS is pressed, the shovel 100 is operated autonomously so that the predetermined portion moves along the target trajectory.

In this embodiment, the autonomous control unit 30C is configured to assist an operator in manually operating the shovel by autonomously operating an actuator. For example, if the operator manually performs an arm closing operation the arm while pressing the switch NS, the autonomous control unit 30C may autonomously expand or contract at least one of the boom cylinder 7, the arm cylinder 8 and the bucket cylinder 9 so that the target trajectory coincides with the position of the claw edge of the bucket 6. In this case, the operator can close the arm 5 while aligning the claw edge of the bucket 6 with the target trajectory by simply operating the left operation lever 26L in the arm closing direction, for example. In this example, the arm cylinder 8, which is a main operation target, is referred to as a "main actuator." Also, the boom cylinder 7 and the bucket cylinder 9, which are driven according to the movement of the main actuator, are referred to as "dependent actuators."

In this embodiment, the autonomous control unit 30C can operate each actuator autonomously by providing a current command to the proportional valve 31 to adjust the pilot pressure applied to the control valve corresponding to the actuator individually. For example, at least one of the boom cylinder 7 and the bucket cylinder 9 can be operated regardless of whether the right operation lever 26R is tilted.

The control mode switch unit 30D is configured to be capable of switching the control mode. The control mode is a control method for an actuator available to the controller 30 when the autonomous control section 30C causes the shovel 100 to operate autonomously, including, for example, a normal control mode and a slow control mode. The normal control mode may be, for example, a control mode where the movement speed of a predetermined portion relative to an operation amount of the control device 26 is set to be relatively large, and the slow control mode where the movement speed of the predetermined portion relative to the operation amount of the control device 26 is set to be relatively small. The control mode may include an arm priority mode and a boom priority mode.

Any control mode is utilized when the operation device 26 is operated during the switch NS being pressed. For example, the arm priority mode is a control mode where the arm cylinder 8 is selected as the main actuator and the boom cylinder 7 and the bucket cylinder 9 are selected as the dependent actuators. In the arm priority mode, for example, when the left control lever 26L is operated in the arm closing direction, the controller 30 actively extends the arm cylinder 8 at a speed proportional to the operation amount of the left operation lever 26L. Then, the controller 30 passively expands and contracts at least one of the boom cylinder 7 and the bucket cylinder 9 such that the claw edge of the bucket 6 moves along the target trajectory. The boom priority mode is a control mode where the boom cylinder 7 is selected as the main actuator and the arm cylinder 8 and the bucket cylinder 9 are selected as the dependent actuators. In the boom priority mode, for example, when the left operation lever 26L is operated in the arm closing direction, the controller 30 actively expands and contracts the boom cylinder 7 at a speed proportional to the operation amount of the left operation lever 26L. Then, the controller 30 passively extends the arm cylinder 8 so that the claw edge of the bucket 6 moves along the target trajectory and, if necessary, passively expands and contracts the bucket cylinder 9. Note that the control mode may include a bucket priority mode. The bucket priority mode is a control mode where the bucket cylinder 9 is selected as the main actuator and the boom cylinder 7 and the arm cylinder 8 are selected as the dependent actuators. In the bucket priority mode, for example, when the left operation lever 26L is operated in the arm closing direction, the controller 30 actively expands and contracts the bucket cylinder 9 at a speed proportional to the operational amount of the left operation lever 26L. Then, the controller 30 passively extends the arm cylinder 8 so that the claw edge of the bucket 6 moves along the target trajectory and, if necessary, passively expands and contracts the boom cylinder 7.

The control mode switch unit 30D may be configured to, if a predetermined condition is satisfied, automatically switch the control mode. The predetermined condition may be set based on, for example, the shape of the target trajectory, the presence or absence of a buried object, the presence or absence of an object around the shovel 100, or the like.

When the autonomous control is started, for example, the controller 30 first adopts a first control mode. The first control mode may be, for example, the normal control mode. Then, if it is determined that a predetermined condition is satisfied during execution of the autonomous control in the first control mode, the control mode switch unit 30D switches the control mode from the first control mode to a second control mode. The second control mode may be, for example, a slow control mode. In this case, the controller 30 terminates the autonomous control employing the first control mode and starts the autonomous control employing the second control mode. In this example, the controller 30 may select one of the two control modes to perform the autonomous control, but may select one of three or more control modes to perform the autonomous control.

Figure 6:
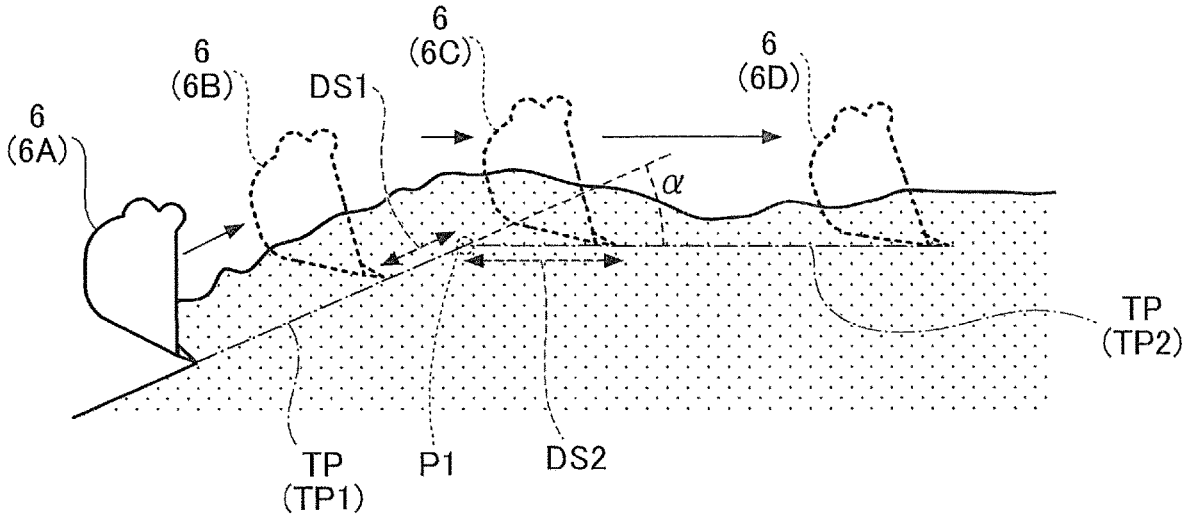
FIG. 6 is a diagram for illustrating one exemplary control mode switch operation.

Next, one exemplary operation where the control mode switch unit 30D automatically switches the control mode (hereinafter referred to as "control mode switch operation") is described with reference to FIG. 6. FIG. 6 shows a cross-section of a to-be-excavated ground. A dotted line in the figure represents target trajectory TP. Also, the bucket 6A drawn by a solid line represents the current position and posture of the bucket 6, and each of the buckets 6B to 6D drawn by dotted lines represents the subsequent position and posture of the bucket 6.

In the example of FIG. 6, when the left operation lever 26L is operated in the arm closing direction while the switch NS is pressed, the controller 30 performs the autonomous control in the normal control mode so that the claw edge of the bucket 6 moves along the target trajectory TP.

Then, if the distance DS1 between point P1 on the target trajectory TP and the claw edge of the bucket 6 is less than a predetermined distance TH1, the controller 30 determines that the predetermined condition is satisfied and switches the control mode from the normal control mode to the slow control mode. The point P1 is a boundary point between trajectory portions TP1 and TP2 composing the target trajectory TP. The angle $\alpha$ is the angle formed between extension lines of the trajectory portions TP1 and TP2. The bucket 6B represents the position and orientation of the bucket 6 when the control mode is switched from the normal control mode to the slow control mode. Thus, if the angle formed between the two trajectory portions (two target construction surfaces) is greater than or equal to a predetermined angle, the controller 30 can slow down the movement of the bucket 6 as the claw edge of the bucket 6 as the work portion approaches the boundary point.

In this example, in the state where the size of the angle $\alpha$ is above the predetermined angle $\alpha_{TH}$, when the distance DS1 between the point P1 and the claw edge of the bucket 6 is below the predetermined distance TH1, the controller 30 determines that the predetermined condition is satisfied. Note that the predetermined distance TH1 may be zero.

Also, if the distance between the point P1 and the claw edge of the bucket 6 exceeds a predetermined distance TH2 after the claw edge of the bucket 6 has passed through the point P1, the controller 30 determines that the predetermined condition is satisfied and switches the control mode from the slow control mode to the normal control mode. Note that if the predetermined distance TH1 is not zero, the predetermined distance TH2 may be zero. The bucket 6C represents the position and posture of the bucket 6 when the control mode is switched from the slow control mode to the normal control mode.

According to this arrangement, the controller 30 can change the control mode from the normal control mode to the slow control mode when the claw edge of the bucket 6 passes through a portion where the travelling direction of the target trajectory TP greatly changes. Also, the controller 30 can return the control mode to the normal control mode after the claw edge of the bucket 6 passes through the portion where the travelling direction of the target trajectory TP greatly changes. Thus, the controller 30 can more accurately align the claw edge of the bucket 6 with the target trajectory TP.

In the above example, the case where the bucket 6 moves from the trajectory portion TP1 to the trajectory portion TP2 has been illustrated, but even if the bucket 6 moves from the trajectory portion TP2 to the trajectory portion TP1, the controller 30 may similarly slow down the movement speed of the bucket 6 when the claw edge of the bucket 6 approaches the boundary point.

Figure 7A:
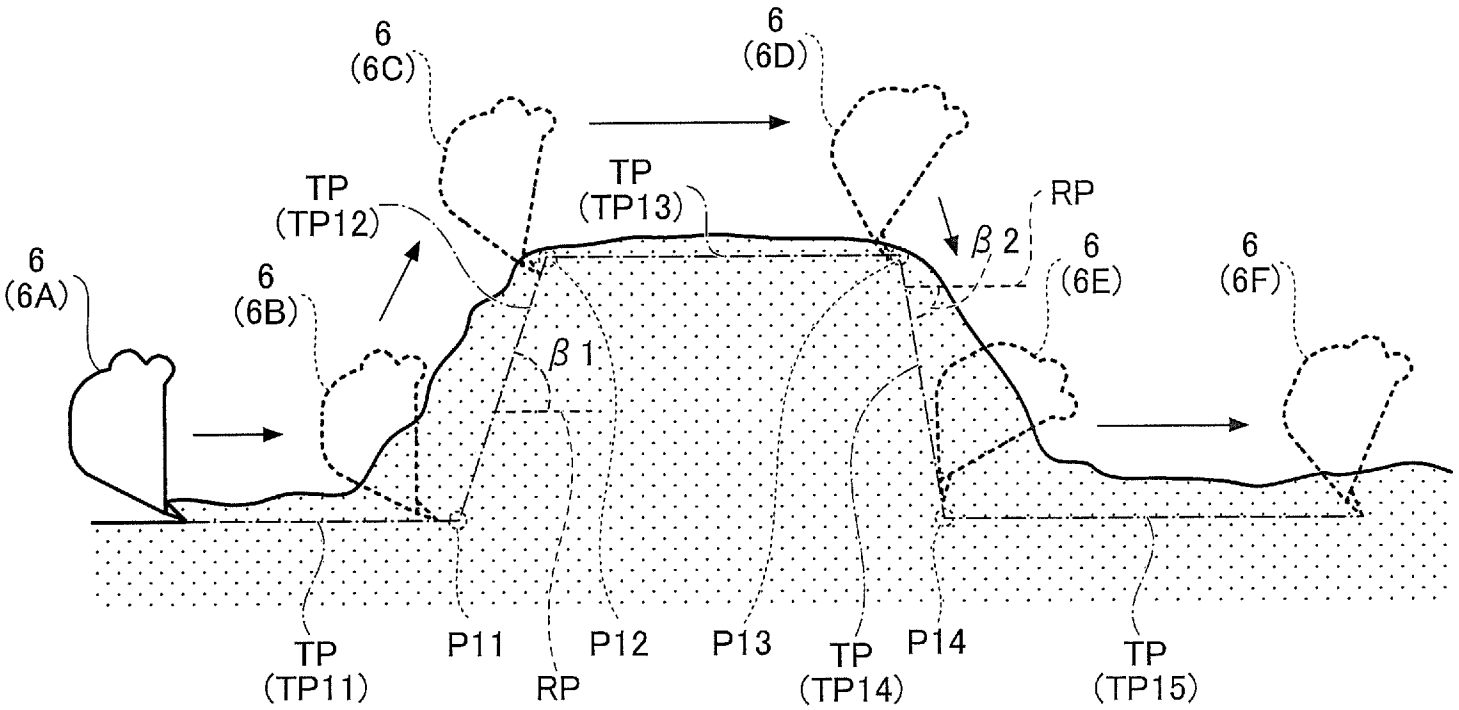
FIG. 7A is a diagram for illustrating another exemplary control mode switch operation.
Figure 7B:
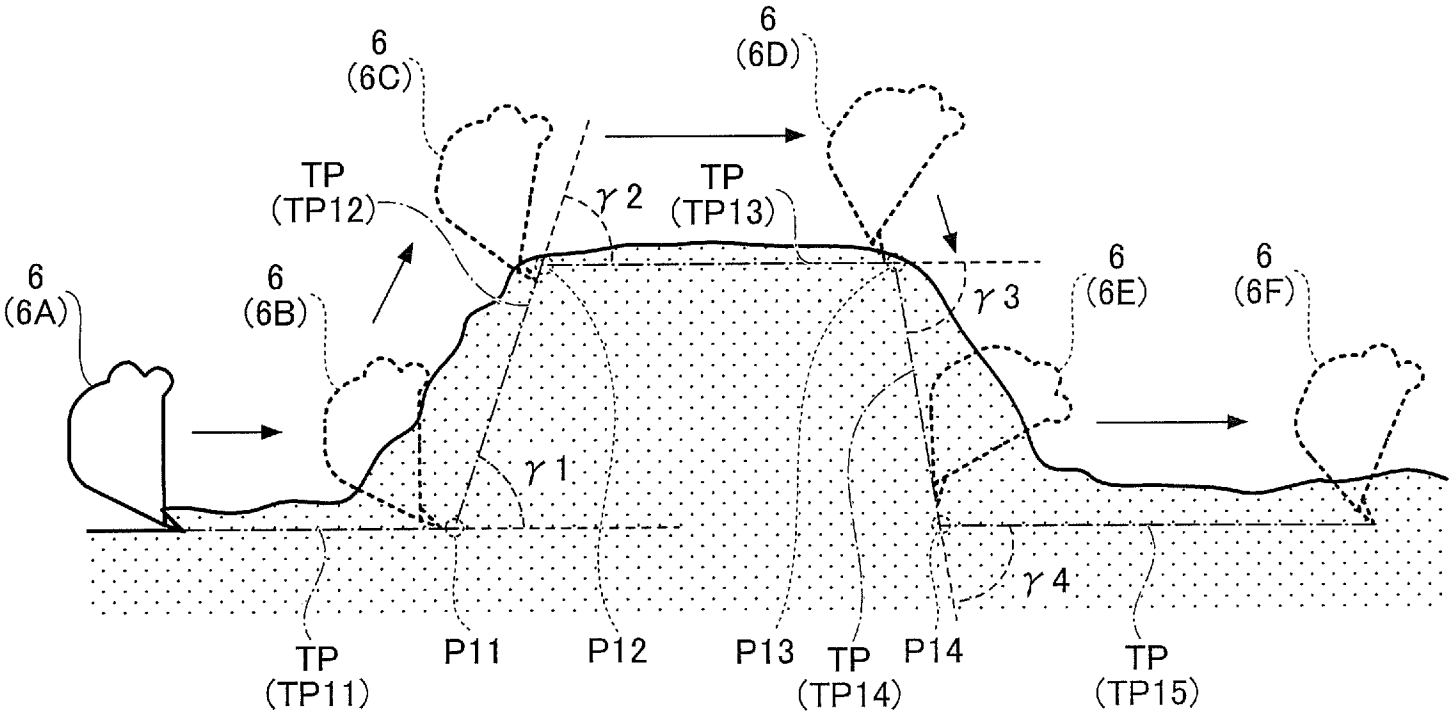
FIG. 7B is a diagram for illustrating another exemplary control mode switch operation.

Next, another exemplary control mode switch operation is described with reference to FIGS. 7A and 7B. FIGS. 7A and 7B show cross-sections of to-be-excavated ground. The dotted lines in FIGS. 7A and 7B represent the target trajectory TP. Also, the bucket 6A drawn by a solid line represents the current position and posture of the bucket 6, and the buckets 6B to 6F drawn by dotted lines each represents the subsequent position and posture of the bucket 6.

Specifically, FIG. 7A shows an example where the control mode is changed based on an angle formed between a predetermined reference plane RP (for example, a horizontal plane, the ground plane of the shovel 100 or the like) and the target trajectory TP, and FIG. 7B shows an example where the control mode is changed based on an angle formed between two adjacent trajectory portions.

In the example of FIG. 7A, when the left operation lever 26L is operated in the arm closing direction while the switch NS is pressed, the controller 30 performs the autonomous control using the arm priority mode so that the claw edge of the bucket 6 moves along the target trajectory TP.

Then, when the distance between the boundary point P11 on the target trajectory TP and the claw edge of the bucket 6 is less than a predetermined distance TH3, the controller 30 determines that the predetermined condition is satisfied and switches the control mode from the arm priority mode to the boom priority mode. The boundary point P11 is a boundary point between the trajectory portions TP11 and TP12 composing the target trajectory TP. An angle 161 is an angle formed between the horizontal plane, which is the reference plane RP, and the trajectory portion TP 12. The bucket 6B represents the position and posture of the bucket 6 when the control mode is switched from the arm priority mode to the boom priority mode.

In this example, in the state where the size of the angle $\beta 1$ is greater than or equal to a predetermined angle $\beta_{TH}$, when the distance between the boundary point P11, which is the start point of the trajectory portion TP 12, and the claw edge of the bucket 6 is below the predetermined distance TH3, the controller 30 determines that the predetermined condition is satisfied.

Also, if the distance between the boundary point P12 on the target trajectory TP and the claw edge of the bucket 6 falls below a predetermined distance TH4 after the claw edge of the bucket 6 passes through the boundary point P11, the controller 30 determines that the predetermined condition is satisfied and switches the control mode from the boom priority mode to the arm priority mode. The boundary point P12 is a boundary point between the trajectory portion TP12 and TP13 composing the target trajectory TP. The bucket 6C represents the position and posture of the bucket 6 when the control mode is switched from the boom priority mode to the arm priority mode.

In this example, in the state where an angle formed between the horizontal plane, which is the reference plane RP, and the trajectory portion TP13 is less than the predetermined angle $\beta_{TH}$, when the distance between the boundary point P12, which is the start point of the trajectory portion TP13, and the claw edge of the bucket 6 is below a predetermined distance TH4, the controller 30 determines that the predetermined condition is satisfied. Then, since the angle formed between the horizontal plane and the trajectory portion TP13 is less than the predetermined angle $\beta_{TH}$, the controller 30 determines that the predetermined condition has been satisfied when the bucket 6 reaches the position shown in the bucket 6C, and switches the control mode from the boom priority mode to the arm priority mode.

Then, if the distance between the boundary point P13 on the target trajectory TP and the claw edge of the bucket 6 falls below a predetermined distance TH5 after the claw edge of the bucket 6 passes through the boundary point P12, the controller 30 determines that the predetermined condition is satisfied and switches the control mode from the arm priority mode to the boom priority mode. The boundary point P13 is a boundary point between the trajectory portions TP13 and TP14 composing the target trajectory TP. An angle $\beta 2$ is an angle formed between the horizontal plane, which is the reference plane RP, and the trajectory portion TP14. The bucket 6D represents the position and posture of the bucket 6 when the control mode is switched from the arm priority mode to the boom priority mode.

In this example, in the state where the size of the angle $\alpha 2$ is greater than or equal to the predetermined angle $\beta_{TH}$ when the distance between the boundary point P13, which is the start point of the trajectory portion TP14, and the claw edge of the bucket 6 falls below a predetermined distance TH5, the controller 30 determines that the predetermined condition is satisfied.

Also, if the distance between the boundary point P14 on the target trajectory TP and the claw edge of the bucket 6 falls below a predetermined distance TH6 after the claw edge of the bucket 6 passes through the boundary point P13, the controller 30 determines that the predetermined condition is satisfied and switches the control mode from the boom priority mode to the arm priority mode. The boundary point P14 is a boundary point between the trajectory portions TP14 and TP15 composing the target trajectory TP. The bucket 6E represents the position and posture of the bucket 6 when the control mode is switched from the boom priority mode to the arm priority mode.

In this example, in the state where when the size of an angle formed between the horizontal plane, which is the reference plane RP, and the trajectory portion TP15 is less than the predetermined angle $\beta_{TH}$, when the distance between the boundary point P14, which is the start point of the trajectory portion TP15, and the claw edge of the bucket 6 falls below a predetermined distance TH6, the controller 30 determines that the predetermined condition is satisfied.

Then, since the angle formed between the horizontal plane and the trajectory portion TP15 is less than the predetermined angle $\beta_{TH}$, the controller 30 determines that the predetermined condition has been satisfied when the bucket 6 reaches the position shown in the bucket 6E, and switches the control mode from the boom priority mode to the arm priority mode.

Note that the predetermined distances TH3 to TH6 may be different or the same. Also, at least one of the predetermined distances TH3 to TH6 may be zero.

According to this arrangement, the controller 30 can employ the boom priority mode as the control mode when the claw edge of the bucket 6 passes through a sharply steep trajectory portion of the target trajectory TP where the tilt angle with respect to the reference plane is greater than or equal to a predetermined angle $\beta_{TH}$. Also, the arm priority mode can be employed as the control mode when the claw edge of the bucket 6 passes through a gently sloped trajectory portion where the tilt angle is less than the predetermined angle $\beta_{TH}$. Thus, the controller 30 can more accurately align the claw edge of the bucket 6 along the target trajectory TP. If the arm priority mode is adopted when the claw edge of the bucket 6 passes through the sharply steep trajectory portion, the arm 5 may be moved too much. However, if the boom priority mode is adopted, excessive movement of the arm 5 can be prevented. Also, if the boom priority mode is adopted when the claw edge of the bucket 6 passes through the gently sloped trajectory portion, the boom 4 may be excessively moved. However, when the arm priority mode is adopted, excessive movement of the boom 4 can be prevented.

Also, when the claw edge of the bucket 6 passes near a boundary point (for example, the boundary points P11 to P14) of the steeply sloped trajectory portion of the target trajectory TP where the tilt angle with respect to the reference plane is greater than or equal to the predetermined angle $\beta_{TH}$, the controller 30 may employ the slow control mode as the control mode. Specifically, when the distance between the boundary point and the claw edge of the bucket 6 is less than a predetermined distance V, the controller 30 may determine that the predetermined condition is satisfied and switch the control mode to the slow control mode. In this case, the predetermined distance V may be set as a distance different from each of predetermined distances TH3 to TH6 and may be set as the same distance as each of predetermined distances TH3 to TH6. For example, the predetermined distance V may be a distance greater than each of the predetermined distances TH3 to TH6.

In the example of FIG. 7B, when the left operation lever 26L is operated in the arm closing direction while the switch NS is pushed, the controller 30 performs the autonomous control using the arm priority mode so that the claw edge of the bucket 6 moves along the target trajectory TP.

In this example, in the state where the size of the angle $\gamma$1 formed between an extension line of the trajectory portion TP11 and the trajectory portion TP12 is greater than or equal to a predetermined angle $\gamma_{TH}$, when the distance between the boundary point P11 and the claw edge of the bucket 6 is below a predetermined distance TH7, the controller 30 determines that the predetermined condition is satisfied. Then, the control mode is switched from the arm priority mode to the boom priority mode. The bucket 6B represents the position and posture of the bucket 6 when the control mode is switched from the arm priority mode to the boom priority mode.

Also, in the state where the size of the angle $\gamma$2 formed between an extension line of the trajectory portion TP12 and the trajectory portion TP13 is greater than or equal to the predetermined angle $\gamma_{TH}$, when the distance between the boundary point P12 on the target trajectory TP and the claw edge of the bucket 6 is below a predetermined distance TH8, the controller 30 determines that the predetermined condition is satisfied. Then, the control mode is switched from the boom priority mode to the arm priority mode. The bucket 6C represents the position and posture of the bucket 6 when the control mode is switched from the boom priority mode to the arm priority mode.

In the state where the size of the angle $\gamma$3 formed between an extension line of the trajectory portion TP13 and the trajectory portion TP14 is greater than or equal to the predetermined angle $\gamma_{TH}$, when the distance between the boundary point P13 on the target trajectory TP and the claw edge of the bucket 6 is below a predetermined distance TH9, the controller 30 determines that the predetermined condition is satisfied. Then, the control mode is switched from the arm priority mode to the boom priority mode. The bucket 6D represents the position and posture of the bucket 6 when the control mode is switched from the arm priority mode to the boom priority mode.

In the state where the size of the angle $\gamma$4 formed between an extension line of the trajectory portion TP14 and the trajectory portion TP15 is greater than or equal to the predetermined angle $\gamma_{TH}$, when the distance between the boundary point P14 on the target trajectory TP and the claw edge of the bucket 6 is below a predetermined distance TH10, the controller 30 determines that the predetermined condition is satisfied. The control mode is switched from the boom priority mode to the arm priority mode. The bucket 6E represents the position and posture of the bucket 6 when the control mode is switched from the boom priority mode to the arm priority mode.

Note that the predetermined distances TH7 to TH10 may be different or the same. Also, at least one of the predetermined distances TH7 to TH10 may be zero.

According to this arrangement, when the travelling direction of the target trajectory TP changes significantly, the controller 30 can select the control mode suitable for subsequent trajectory portions. For example, one of the boom priority mode and the arm priority mode can be switched to the other. Thus, the controller 30 can more accurately align the claw edge of the bucket 6 along the target trajectory TP.

Also, when the claw edge of the bucket 6 passes near a boundary point (for example, the boundary points P11 to P14) of the two trajectory portions where the angle formed between the two adjacent trajectory portions is greater than or equal to the predetermined angle $\gamma_{TH}$, the controller 30 may employ the slow control mode as the control mode. Specifically, if the distance between the boundary point and the claw edge of the bucket 6 is below a predetermined distance W, the controller 30 may determine that the predetermined condition is satisfied and switch the control mode to the slow control mode. In this case, the predetermined distance W may be set as a distance different from each of the predetermined distances TH7 to TH10 and may be set as the same distance as each of predetermined distances TH7 to TH10. For example, the predetermined distance W may be a distance greater than each of the predetermined distances TH7 to TH10.

Figure 8:
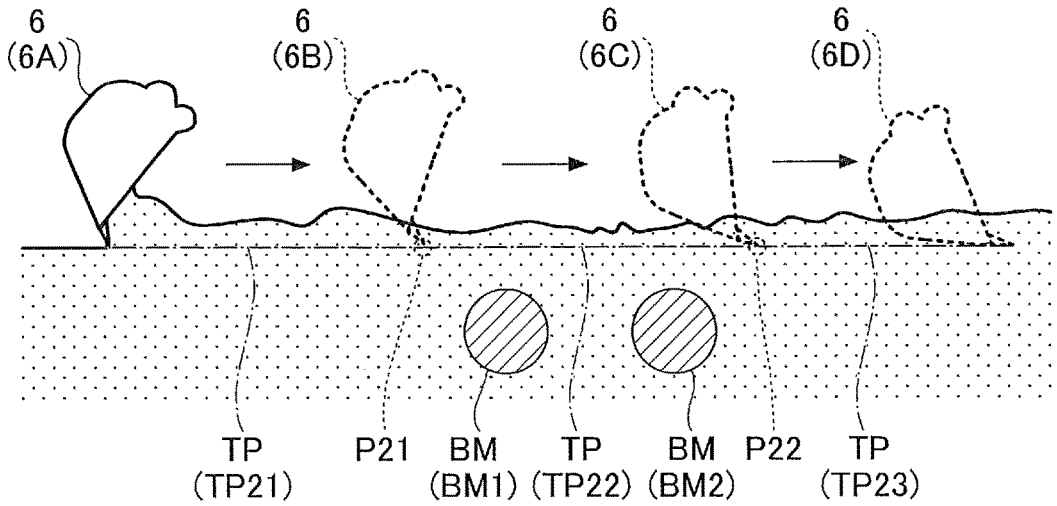
FIG. 8 is a diagram for illustrating a still further exemplary control mode switch operation.

Next, one still further exemplary control mode switch operation is described with reference to FIG. 8. FIG. 8 shows a cross section of to-be-excavated ground. A dotted line in the figure represents the target trajectory TP. Also, the bucket 6A drawn by a solid line represents the current position and posture of the bucket 6, and each of the buckets 6B to 6D drawn by dotted lines represents the subsequent position and posture of the bucket 6. The striped pattern represents a cross section of embedded object BM such as a water pipe.

In the example of FIG. 8, when the left operation lever 26L is operated in the arm closing direction while the switch NS is pushed, the controller 30 performs the autonomous control using the normal control mode so that the claw edge of the bucket 6 moves along the target trajectory TP.

Then, if the distance between the point P21 on the target trajectory TP and the claw edge of the bucket 6 is below a predetermined distance TH11, the controller 30 determines that the predetermined condition is satisfied and switches the control mode from the normal control mode to the slow control mode. The point P21 is a boundary point between the trajectory portion TP21 and the trajectory portion TP22 composing the target trajectory TP. The trajectory portion TP22 is the trajectory portion which is set near the buried object BM. In this example, the trajectory portion TP22 is a set of points on the target trajectory TP where the distance from the buried object BM is less than a predetermined distance X. Therefore, the distance between the point P21 and a buried object BM1 is equal to the predetermined distance X. The bucket 6B represents the position and posture of the bucket 6 when the control mode is switched from the normal control mode to the slow control mode.

Also, if the distance between the point P22 on the target trajectory TP and the claw edge of the bucket 6 is below a predetermined distance TH12, the controller 30 determines that the predetermined condition is satisfied and switches the control mode from the slow control mode to the normal control mode. The point P22 is a boundary point between the trajectory portion TP22 and the trajectory portion TP23 composing the target trajectory TP. The distance between the point P22 and a buried object BM2 is equal to the predetermined distance X. The bucket 6C represents the position and posture of the bucket 6 when the control mode is switched from the slow control mode to the normal control mode.

Note that the predetermined distances TH11 and TH12 may be different or the same. Also, at least one of the predetermined distances TH11 and TH12 may be zero.

According to this arrangement, when the claw edge of the bucket 6 passes near the buried object BM, the controller 30 can change the control mode from the normal control mode to the slow control mode. Also, when the claw edge of the bucket 6 is away from the buried object BM, the controller 30 can return the control mode to the normal control mode. Therefore, if the claw edge of the bucket 6 moves along the target trajectory TP, the controller 30 can control the claw edge of the bucket 6 accurately at a low speed and prevent the claw edge of the bucket 6 from significantly damaging the buried object.

Figure 9A:
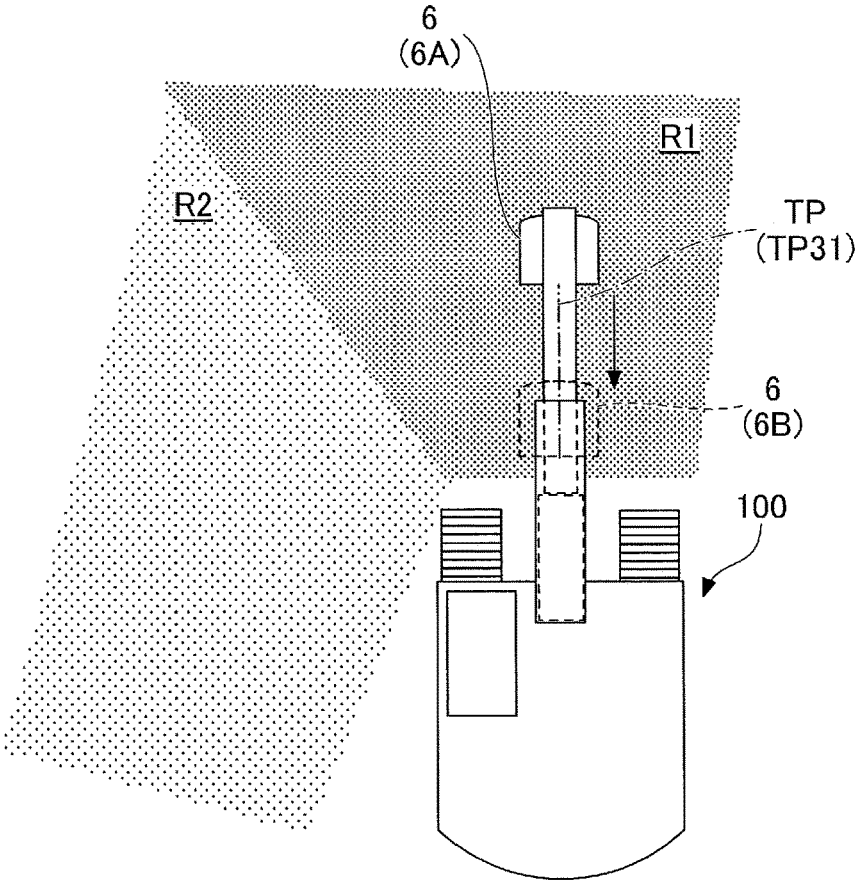
FIG. 9A is a diagram for illustrating a still further exemplary control mode switch operation.
Figure 9B:
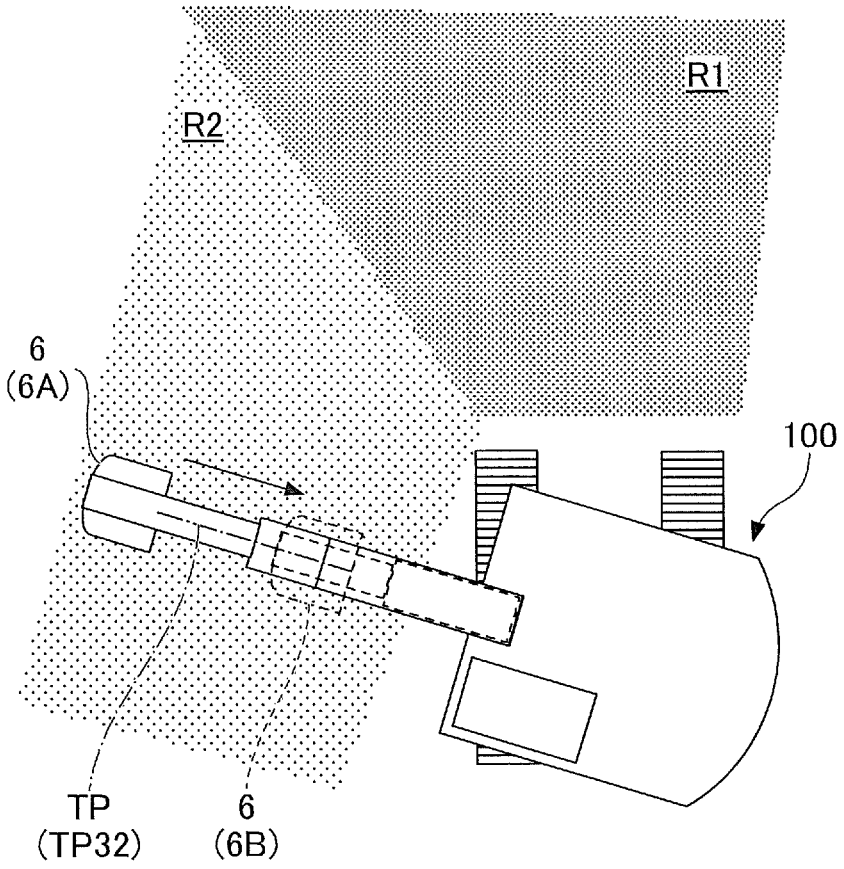
FIG. 9B is a diagram for illustrating a still further exemplary control mode switch operation.

Next, one still further exemplary control mode switch operation is described with reference to FIGS. 9A and 9B. FIGS. 9A and 9B are top views of to-be-excavated ground and the shovel 100. Dashed lines in FIGS. 9A and 9B represent the target trajectory TP. The target trajectory TP is set to be gradually deeper between the current ground and the target construction surface, for example, such that the target construction surface is formed by multiple excavations. Also, the bucket 6A drawn by a solid line represents the current position and posture of the bucket 6, and the bucket 6B drawn by a dotted line represents the subsequent position and posture of the bucket 6. A fine dotted area represents a portion R1 (a relatively deep portion) where the vertical distance between the currently set target trajectory TP and the target construction surface is relatively small, and a coarse dotted area represents a portion R2 (a relatively shallow portion) where the vertical distance between the currently set target trajectory TP and the target construction surface is relatively large.

In the example of FIG. 9A, when the left operation lever 26L is operated in the arm closing direction while the switch NS is pushed, the controller 30 performs the semi-automatic control so that the claw edge of the bucket 6 moves along the target trajectory TP31.

Then, if it is determined that the vertical distance between the target trajectory TP31 and the target construction surface is less than a predetermined distance Y, the controller 30 determines that the predetermined condition is satisfied and switches the control mode from the normal control mode to the slow control mode. The bucket 6A represents the position and posture of the bucket 6 when the control mode is switched from the normal control mode to the slow control mode. The bucket 6B represents the position and posture of the bucket 6 when the claw edge of the bucket 6 reaches the end of the target trajectory TP.

In the example of FIG. 9B, as in FIG. 9A, when the left operation lever 26L is operated in the arm closing direction while the switch NS is pushed, the controller 30 performs the semi-automatic control so that the claw edge of the bucket 6 moves along the target trajectory TP32. The operator of the shovel 100 performs a left pivot operation, for example, immediately after completion of the excavation operation shown in FIG. 9A, to transition the orientation of an excavation attachment AT to one as shown in FIG. 9B. Then, the operator starts the excavation operation shown in FIG. 9B. Thus, the excavation operation shown in FIG. 9A and the excavation operation shown in FIG. 9B can be recognized as a series of excavation operations.

In the excavation operation shown in FIG. 9B, the controller 30 first determines whether the vertical distance between the target trajectory TP32 and the target construction surface is less than the predetermined distance Y. Then, if it is determined that the distance is not less than the predetermined distance Y, it is determined that the predetermined condition is not satisfied. Therefore, the controller 30 performs the semi-automatic control using the normal control mode without changing the control mode from the normal control mode to the slow control mode.

In this manner, the controller 30, if the semi-automatic control is performed to excavate a portion R1, automatically selects the slow control mode and, if the semi-automatic control is performed to excavate a portion R2, automatically selects the normal control mode. Namely, the controller 30 automatically selects an appropriate control mode depending on the state of a to-be-excavated portion, such as the vertical distance between the target construction surface and the target trajectory TP, without forcing the operator of the shovel 100 to perform switch operations of the control mode. Specifically, a finishing mode (slow control mode) is selected for the portion R1, and the normal control mode is selected for the portion R2. Therefore, the operational efficiency of the shovel 100 can be improved.

Figure 10:
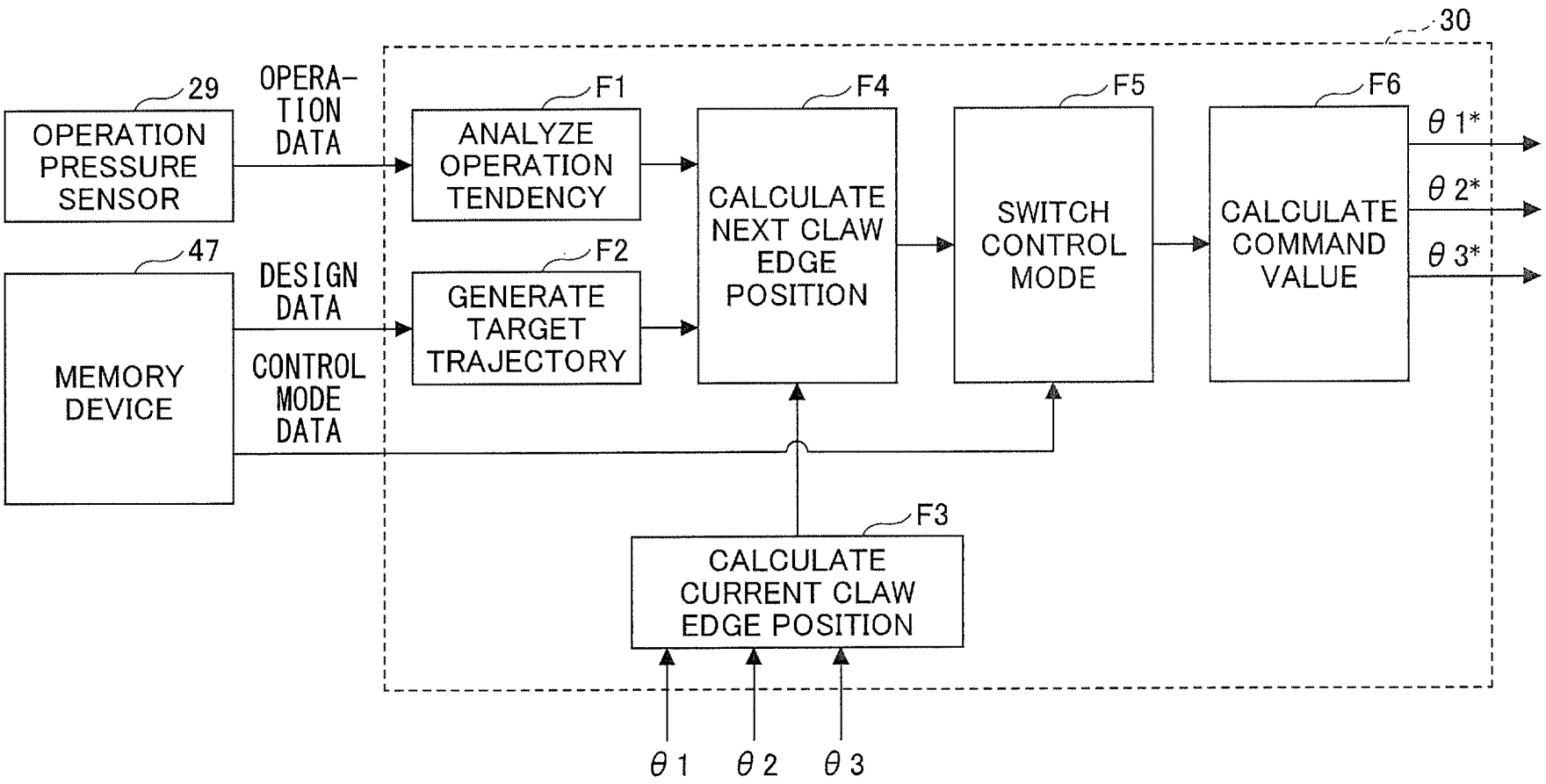
FIG. 10 is a block diagram for illustrating one exemplary relationship of functional elements related to execution of semi-automatic control at a controller.

Next, the semi-automatic control by the controller 30 is described in detail with reference to FIG. 10. FIG. 10 is a block diagram for illustrating one exemplary relationship between functional elements F1 to F6 regarding execution of semi-automatic control at the controller 30.

The controller 30 has the functional elements F1 to F6 related to execution of the semi-automatic control, as shown in FIG. 10. The functional elements may be composed of software, hardware, or a combination of software and hardware.

The function element F1 is configured to analyze operational tendency that is a tendency of operator's manual operations. In this embodiment, the functional element F1 analyzes the operational tendency based on operation data fed from the operation pressure sensor 29 and outputs the analysis result together with the operation data. For example, the operational tendency is the operation tendency for bringing the claw edge of the bucket 6 close to the body linearly, the operation tendency for bringing the claw edge of the bucket 6 away from the body linearly, the operation tendency for lifting the claw edge of the bucket 6 linearly, and the operation tendency for dropping the claw edge of the bucket 6 linearly. Then, the function element F1 outputs an analysis result as to whether the current operation tendency matches any of the operation tendencies.

The functional element F2 is configured to generate a target trajectory. In this embodiment, the functional element F2 corresponds to the trajectory acquisition unit 30B shown in FIG. 5. Specifically, the functional element F2 refers to design data stored in the storage device 47 mounted to the shovel 100 and generates a trajectory to be traversed by the claw edge of the bucket 6 during excavation or the like.

The storage device 47 is configured to store various information. The storage device 47 may be a non-volatile storage medium such as a semiconductor memory, for example. The storage device 47 may store information fed from various devices during operation of the shovel 100 and may store the information acquired via the various devices before starting the operation of the shovel 100. The storage device 47 may store data related to a target construction surface acquired via a communication device or the like, for example. The target construction surface may be set by the operator of the shovel 100 or may be set by the construction manager or others.

The functional element F3 is configured to calculate the current claw edge position. In this embodiment, the functional element F3 corresponds to the position calculation unit 30A shown in FIG. 5. Specifically, the functional element F3 calculates the coordinate point of the claw edge of the bucket 6 as the current claw edge position based on the boom angle θ1 detected by the boom angle sensor S1, the arm angle θ2 detected by the arm angle sensor S2 and the bucket angle θ3 detected by the bucket angle sensor S3. The functional element F3 may use an output of the body tilt sensor S4 to calculate the current claw edge position.

The functional element F4 is configured to calculate the next claw edge position. In this embodiment, the functional element F4 calculates the claw edge position after passage of a predetermined time as a target claw edge position based on an analysis result of the operation data and the operation tendency fed from the functional element F1, the target trajectory generated by the functional element F2, and the current claw edge position calculated by the functional element F3.

The function element F5 is configured to switch the control mode. In this embodiment, the functional element F5 corresponds to the control mode switch unit 30D shown in FIG. 5. Specifically, the functional element F5 refers to control mode data stored in the storage device 47 and selects either the normal control mode or the slow control mode as the control mode.

The functional element F6 is configured to calculate a command value for operating an actuator. In this embodiment, when the normal control mode is selected, the functional element F6 calculates at least one of a boom command value θ 1*, an arm command value θ2*, and a bucket command value θ3* based on the target claw edge position calculated by the functional element F4 to move the current claw edge position to the target claw edge position at a relatively high movement speed.

Also, when the slow control mode is selected, the functional element F6 calculates at least one of the boom command value θ1*, the arm command value θ2*, and the bucket command value θ 3* based on the target claw edge position calculated by the functional element F4 to move the current claw edge position to the target claw edge position at a relatively small movement speed.

Figure 11:
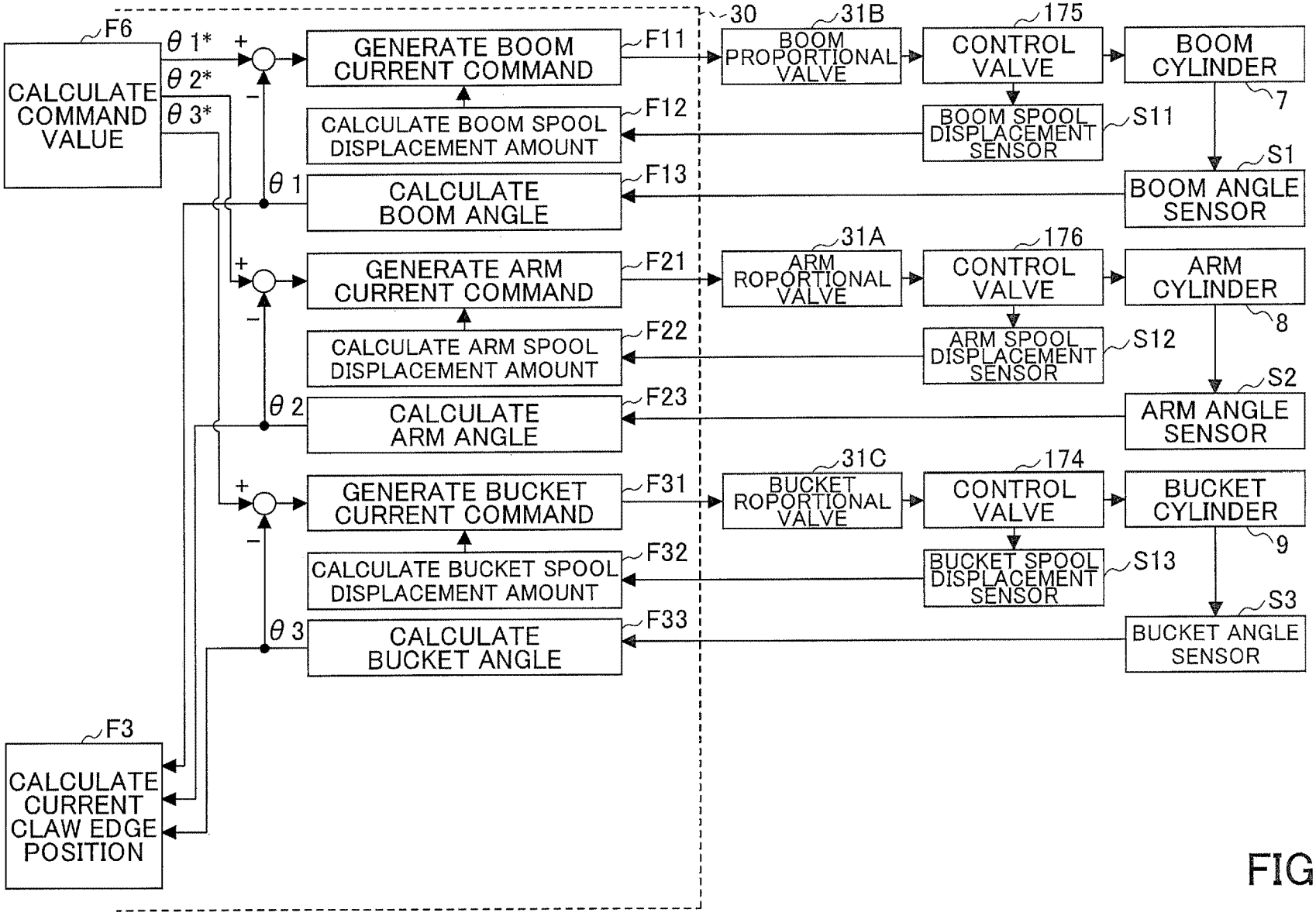
FIG. 11 is a block diagram for illustrating one exemplary arrangement of functional elements for calculating various command values.

Next, the functional element F6 is described in detail with reference to FIG. 11. FIG. 11 is a block diagram for illustrating an exemplary arrangement of the functional element F6 for calculating various command values.

The controller 30 further includes functional elements F11 to F13, F21 to F23, and F31 to F33 for generating command values, as shown in FIG. 11. The functional elements may consist of software, hardware, or a combination of software and hardware.

The functional elements F11 to F13 are functional elements for the boom command value θ1*, functional elements F21 to F23 are functional elements for the arm command value θ2*, and functional elements F31 to F33 are functional elements for the bucket command value θ3*.

The functional elements F11, F21 and F31 are configured to generate a current command fed for the proportional valve 31. In this embodiment, the functional element F11 outputs a boom current command to the boom proportional valve 31B (see the proportional valves 31BL and 31BR in FIG. 4B), the functional element F21 outputs an arm current command to the arm proportional valve 31A (see the proportional valves 31AL and 31AR in FIG. 4A), and the functional element F31 outputs a bucket current command to the bucket proportional valve 31C (see the proportional valves 31CL and 31CR in FIG. 4C).

The functional elements F12, F22 and F32 are configured to calculate the displacement amount of a spool constituting a spool valve. In this embodiment, the functional element F12 calculates the displacement amount of the boom spool constituting the control valve 175 with respect to the boom cylinder 7 based on an output of the boom spool displacement sensor S11. The functional element F22 calculates the displacement amount of an arm spool constituting the control valve 176 with respect to the arm cylinder 8 based on an output of the arm spool displacement sensor S12. The functional element F23 calculates the displacement amount of a bucket spool constituting the control valve 174 with respect to the bucket cylinder 9 based on an output of the bucket spool displacement sensor S13.

The functional elements F13, F23 and F33 are configured to calculate the rotational angle of a workpiece. In this embodiment, the functional element F13 calculates the boom angle θ1 based on an output of the boom angle sensor S1. The functional element F23 calculates the arm angle θ2 based on an output of the arm angle sensor S2. The functional element F33 calculates the bucket angle θ3 based on an output of the bucket angle sensor S3.

Specifically, the functional element F11 basically generates a boom current command for the boom proportional valve 31B such that the difference between the boom command value θ1* generated by the functional element F6 and the boom angle θ1 calculated by the functional element F13 is zero. At this time, the function element F11 adjusts the boom current command such that the difference between a target boom spool displacement amount derived from the boom current command and a boom spool displacement amount calculated by the function element F12 is zero. Then, the functional element F11 outputs the adjusted boom current command to the boom proportional valve 31B.

The boom proportional valve 31B changes an opening area in response to the boom current command to apply the pilot pressure corresponding to the magnitude of the boom command current to a pilot port of the control valve 175. The control valve 175 moves a boom spool in response to the pilot pressure to cause hydraulic oil to flow into the boom cylinder 7. The boom spool displacement sensor S11 detects the displacement of the boom spool and feeds the detection result back to the functional element F12 of the controller 30. The boom cylinder 7 extends or contracts in response to an inflow of the hydraulic oil, and moves the boom 4 up or down. The boom angle sensor S1 detects the rotation angle of the vertically moving boom 4 and feeds the detection result back to the functional element F13 of the controller 30. The function element F13 feeds back the calculated boom angle θ1 to the function element F3.

The functional element F21 basically generates an arm current command for arm proportional valve 31A such that the difference between the arm command value θ2* generated by functional element F6 and the arm angle θ2 calculated by functional element F23 is zero. At this time, the functional element F21 adjusts the arm current command such that the difference between a target arm spool displacement amount derived from the arm current command and an arm spool displacement amount calculated by the functional element F22 is zero. Then, the functional element F21 outputs the adjusted arm current command to the arm proportional valve 31A.

The arm proportional valve 31A changes an opening area in response to the arm current command to apply the pilot pressure corresponding to the magnitude of the arm current command to a pilot port of control valve 176. The control valve 176 moves the arm spool in response to the pilot pressure to cause the hydraulic oil to flow into the arm cylinder 8. The arm spool displacement sensor S12 detects the displacement of the arm spool and feeds the detection result back to the functional element F22 of the controller 30. The arm cylinder 8 expands and contracts in response to the inflow of the hydraulic oil to open and close the arm 5. The arm angle sensor S2 detects the rotation angle of the opening/closing arm 5 and feeds the detection result back to the functional element F23 of the controller 30. The functional element F23 feeds back the calculated arm angle θ2 to the functional element F3.

Similarly, the functional element F31 basically generates a bucket current command for the bucket proportional valve 31C such that the difference between the bucket command value θ3* generated by the functional element F6 and the bucket angle θ3 calculated by the functional element F33 is zero. At this time, the functional element F31 adjusts the bucket current command such that the difference between a target bucket spool displacement amount derived from the bucket current command and a bucket spool displacement amount calculated by the functional element F32 is zero. Then, the functional element F31 outputs the adjusted bucket current command to the bucket proportional valve 31C.

The bucket proportional valve 31C changes an opening area in response to the bucket current command to apply the pilot pressure corresponding to the magnitude of the bucket current command to a pilot port of the control valve 174. The control valve 174 moves a bucket spool in response to the pilot pressure to cause the hydraulic oil to flow into the bucket cylinder 9. The bucket spool displacement sensor S13 detects the displacement of the bucket spool and feeds the detection result back to the functional element F32 of the controller 30. The bucket cylinder 9 extends and contracts in response to the inflow of the hydraulic oil to open and close the bucket 6. The bucket angle sensor S3 detects the rotation angle of the opening/closing bucket 6 and feeds the detection result back to the functional element F33 of the controller 30. The functional element F33 feeds back the calculated bucket angle θ3 to functional element F3.

As stated above, the controller 30 forms a three-stage feedback loop for each workpiece. Namely, the controller 30 constitutes a feedback loop for the spool displacement amount, a feedback loop for the rotation angle of a workpiece and a feedback loop for the claw edge position. Therefore, the controller 30 can precisely control the movement of the claw edge of the bucket 6 during the semi-automatic control.

As stated above, the shovel 100 associated with claim 1 of the present application includes a lower travelling body 1, an upper pivot body 3 pivotably mounted to the lower travelling body 1, an attachment provided to the upper pivot body 3, a plurality of actuators for operating the attachment, an operation device 26 provided to the upper pivot body 3, and a controller 30 serving as a control device configured to operate the plurality of actuators in accordance with operations of the operation device 26 in a first direction to move a predetermined portion of the attachment based on position information. The position information may be at least one of information regarding the position of a target construction surface and information regarding the position of the claw edge of the bucket 6, for example. The controller 30 is configured to operate the plurality of actuators in first and second control modes based on position information, for example. Typically, the controller 30 is configured to operate the plurality of actuators in the first and second control modes along a target trajectory TP as a predetermined trajectory derived from the position information.

Specifically, the plurality of actuators may be a boom cylinder 7, an arm cylinder 8, and a bucket cylinder 9 for operating an excavation attachment AT, for example. In this case, the controller 30 may operate the plurality of actuators in response to an operation in the arm closing direction of the left operation lever 26L, which is an example of the operation device 26, to move the claw edge of the bucket 6, which is a predetermined portion of the excavation attachment AT, along the target trajectory TP. Then, the target trajectory TP may include a trajectory portion TP11 as a first trajectory portion where the plurality of actuators are caused to operate in an arm priority mode as the first control mode, and a trajectory portion TP12 as a second trajectory portion where the plurality of actuators are caused to operate in a boom priority mode as the second control mode, for example, as shown in FIG. 7A.

According to this arrangement, the shovel 100 can control the movement of a predetermined portion of the attachment along a predetermined trajectory more appropriately.

Also, the first control mode may be the normal control mode, as shown in FIG. 6. In this case, the second control mode may be the slow control mode. Namely, the movement speed of a predetermined portion relative to the operation amount of the control device 26 in the first control mode may be set to be greater than the movement speed of the predetermined portion relative to the operation amount of the control device 26 in the second control mode.

According to this configuration, for example, the shovel 100 can change the control mode from the normal control mode to the slow control mode when the claw edge of the bucket 6 passes through the trajectory portion where the travelling direction of the target trajectory TP greatly changes. Also, the controller 30 can return the control mode to the normal control mode after the claw edge of the bucket 6 passes through the portion where the travelling direction of the target trajectory TP greatly changes. Thus, the controller 30 can more accurately align the claw edge of the bucket 6 along the target trajectory TP.

Also, as shown in FIG. 7A, the controller 30 may operate the plurality of actuators in the arm priority mode as the first control mode if the angle of the target trajectory TP with respect to a reference plane is less than a predetermined angle $\beta_{TH}$, and operate the plurality of actuators in the arm priority mode as the second control mode if the angle of the target trajectory TP with respect to the reference plane is greater than or equal to the predetermined angle $\beta_{TH}$.

According to this arrangement, when the claw edge of the bucket 6 passes through a trajectory portion of the target trajectory TP where the tilt angle relative to a reference plane is less than the predetermined angle $\beta_{TH}$, the controller 30 can employ the boom priority mode as the control mode. In addition, when the claw edge of the bucket 6 passes through the trajectory portion where the tilt angle relative to the reference plane is greater than or equal to the predetermined angle $\beta_{TH}$, the controller 30 can employ the arm priority mode as the control mode. Thus, the controller 30 can more accurately align the claw edge of the bucket 6 along the target trajectory TP.

Also, as shown in FIG. 8, the controller 30 may operate a plurality of actuators in the normal control mode if a buried object BM is not located near the claw edge of the bucket 6, and operate the plurality of actuators in the slow control mode if the buried object BM is located near the claw edge of the bucket 6.

According to this arrangement, when the claw edge of the bucket 6 passes near the buried object BM, the controller 30 can change the control mode from the normal control mode to the slow control mode. Also, when the claw edge of the bucket 6 is away from the buried object BM, the controller 30 can return the control mode to the normal control mode. Therefore, the controller 30 prevents the claw edge of the bucket 6 from significantly damaging the buried object when the claw edge of the bucket 6 moves along the target trajectory TP.

If an object is recognized around the shovel based on an output of the space recognition device 70 provided to the upper pivot body 3, the controller 30 may operate a plurality of actuators in the slow control mode as the second control mode.

According to this arrangement, if there is an object such as a worker around the shovel 100, the controller 30 can change the control mode from the normal control mode to the slow control mode. Therefore, when the claw edge of the bucket 6 moves along the target trajectory TP, the controller 30 prevents a portion of the shovel 100 from contacting the object. This is because the operator of the shovel 100 can be alerted by slowing down of an excavation attachment AT. Also, the operator can have time to determine whether an operation is necessary to avoid contact between a portion of the shovel 100 and the object.

Also, the controller 30 may operate, if the target trajectory TP is within a predetermined distance range from the shovel 100 and the angle of the target trajectory TP with respect to a reference plane is within a predetermined angle range, the plurality of actuators in the first control mode and otherwise operate the plurality of actuators in the second control mode. In this case, the first control mode may be one of the arm priority mode and the boom priority mode, and the second control mode may be the other of the arm priority mode and the boom priority mode. Determination as to whether the bucket 6 is within the predetermined distance range from the shovel 100 in the target trajectory TP may be made based on a detected value of the posture detection device, for example.

Also, the controller 30 may detect the posture of the attachment based on the detected value from the posture detection device and further determine whether to operate the plurality of actuators in the first or second control mode based on the posture of the attachment. For example, the controller 30 may operate the plurality of actuators in the first control mode if the posture of the attachment is a predetermined posture, and otherwise, operate the plurality of actuators in the second control mode.

The preferred embodiments of the present invention have been described in detail above. However, the present invention is not limited to the embodiments stated above. Various modifications, substitutions, and the like may be applied to the embodiments described above without departing from the scope of the present invention. Also, the features described separately may be combined unless there is a technical inconsistency.

For example, although the embodiments described above employ a hydraulic operation system with a hydraulic pilot circuitry, an electric operation system with an electric pilot circuitry may be employed. If the electric operation system is employed, the controller 30 can easily switch between the manual control mode and the semi-automatic control mode. Then, if the controller 30 switches the manual control mode to the semi-automatic control mode, a plurality of control valves may be separately controlled in response to electrical signals corresponding to the lever operation amount of one electric control lever.

Figure 12:
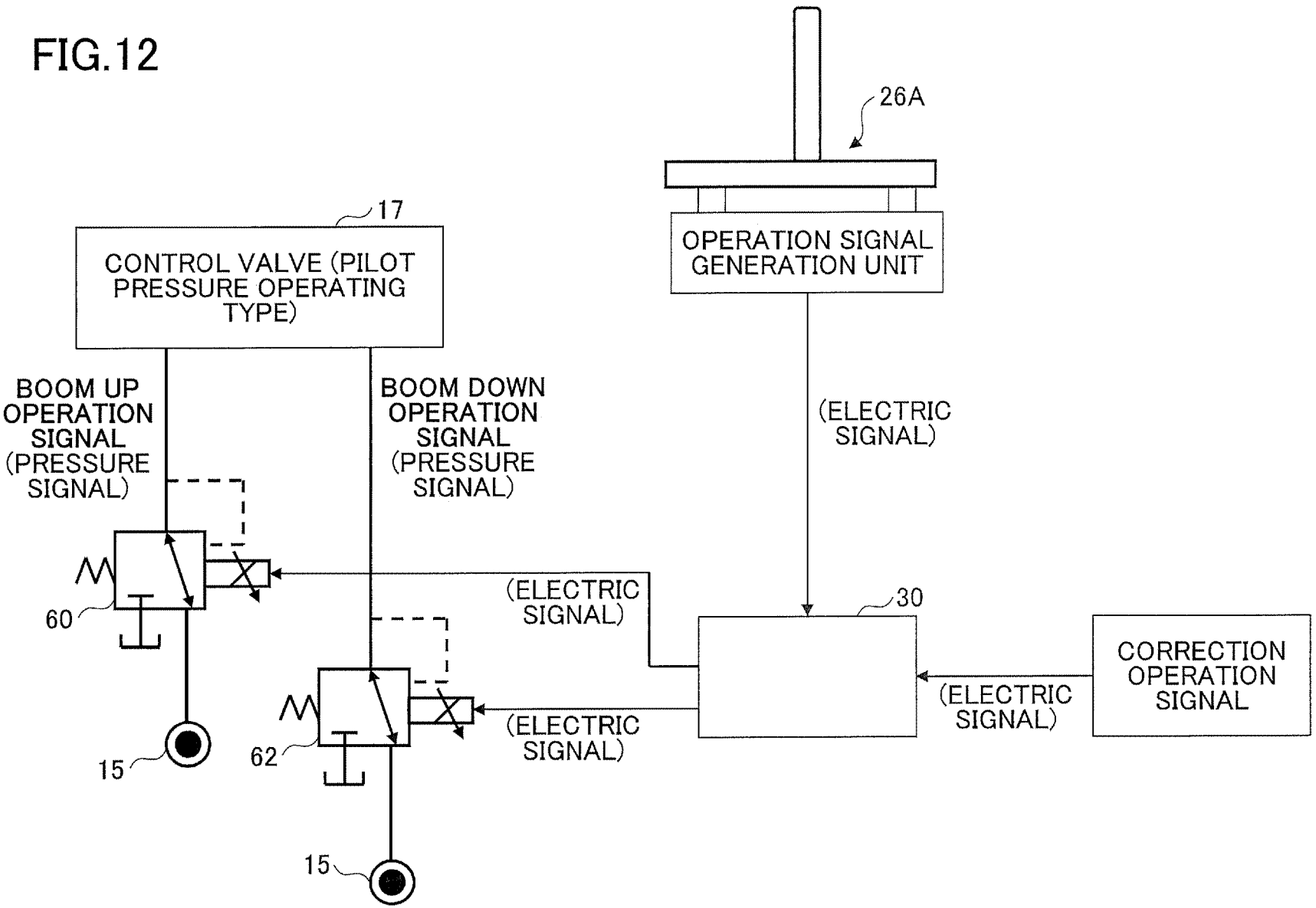
FIG. 12 is a diagram for illustrating one exemplary arrangement of an electric operation system.

FIG. 12 shows an exemplary arrangement of an electric operation system. Specifically, the electric operation system of FIG. 12 is one example of a boom operation system, which mainly composed of a pilot pressure operating type of control valve 17, a boom operation lever 26A as an electric operation lever, a controller 30, a solenoid valve 60 for boom up operation, and a solenoid valve 62 for boom down operation. The electric operation system of FIG. 12 may also be applied to an arm operation system, a bucket operation system, and the like.

The pilot pressure operating type of control valve 17 includes a control valve 175 (see FIG. 3) for the boom cylinder 7, a control valve 176 (see FIG. 3) for the arm cylinder 8, a control valve 174 (see FIG. 3) for the bucket cylinder 9, and the like. The solenoid valve 60 is configured to adjust the flow path area of a conduit for coupling the pilot pump 15 to the upside pilot port of the control valve 175. The solenoid valve 62 is configured to adjust the flow path area of a conduit for coupling the pilot pump 15 to the downside pilot port of the control valve 175.

If manual operations are performed in the manual control mode, the controller 30 generates a boom up operation signal (electric signal) or a boom down operation signal (electric signal) in response to an operation signal (electric signal) fed from an operation signal generation unit of the boom operation lever 26A. The operation signal output by the operation signal generation unit of the boom operation lever 26A is an electric signal that varies depending on the operation amount and direction of the operation of the boom operation lever 26A.

Specifically, if the boom operation lever 26A is operated in the boom up direction, the controller 30 outputs a boom up operation signal (electric signal) corresponding to the lever operation amount to the solenoid valve 60. The solenoid valve 60 adjusts the flow path area in response to the boom up operation signal (electric signal) to control the pilot pressure applied to the upside pilot port of the control valve 175. Similarly, if the boom operation lever 26A is operated in the boom down direction, the controller 30 outputs a boom down operation signal (electric signal) corresponding to the lever operation amount to the solenoid valve 62. The solenoid valve 62 adjusts the flow path area in response to a boom down operation signal (electric signal) to control the pilot pressure applied to the downside pilot port of the control valve 175.

If the semi-automatic control is performed in the semi-automatic control mode, for example, the controller 30 generates a boom up operation signal (electric signal) or a boom down operation signal (electric signal) in response to a correction operation signal (electric signal), instead of an operation signal fed from the operation signal generation unit of the boom operation lever 26A. The correction operation signal may be an electric signal generated by the controller 30 or an electric signal generated by an external controller other than the controller 30.

What is claimed is:

1. A shovel, comprising:

a lower travelling body;

an upper pivot body pivotably mounted to the lower travelling body;

an attachment provided to the upper pivot body;

a plurality of actuators that operate the attachment;

an operation device provided to the upper pivot body; and a hardware processor configured to, in response to an operation of the operation device in a predetermined direction, operate the plurality of actuators to move a predetermined portion of the attachment based on position information, wherein the hardware processor is configured to operate the plurality of actuators in a first control mode and a second control mode by switching between the first control mode and the second control mode based on the position information while moving the predetermined portion of the attachment along a predetermined trajectory set in a target of excavation, and the hardware processor is configured to operate the plurality of actuators in the first control mode when an angle of the predetermined trajectory with respect to a reference plane is less than a predetermined angle, and to operate the plurality of actuators in the second control mode when the angle of the predetermined trajectory with respect to the reference plane is greater than or equal to the predetermined angle.

2. The shovel as claimed in claim 1, wherein a movement speed of the predetermined portion relative to an operation amount of the operation device is greater in the first control mode than in the second control mode.

3. The shovel as claimed in claim 1, wherein the hardware processor is configured to operate the plurality of actuators in the first control mode when a distance between an embedded object and the predetermined portion is greater than a predetermined distance, and to operate the plurality of actuators in the second control mode when the distance between the embedded object and the predetermined portion is smaller than the predetermined distance.

4. The shovel as claimed in claim 1, wherein the hardware processor is configured to operate the plurality of actuators in the second control mode in a portion of the predetermined trajectory which includes a point where a direction of the predetermined trajectory changes by greater than or equal to another predetermined angle.

5. The shovel as claimed in claim 1, wherein the hardware processor is configured to operate the plurality of actuators in the second control mode when an object is recognized around the shovel based on an output of a space recognition device provided to the upper pivot body.

6. The shovel as claimed in claim 1, wherein the hardware processor is configured to operate the plurality of actuators in the first control mode when the predetermined trajectory is within a predetermined distance range from the shovel and the angle of the predetermined trajectory with respect to the reference plane is within a predetermined angle range, and to operate the plurality of actuators in the second control mode otherwise.

7. The shovel as claimed in claim 1, further comprising:

a posture detection device that detects a posture of the attachment, wherein the hardware processor is configured to detect the posture of the attachment based on a detected value from the posture detection device and to determine whether to operate the plurality of actuators in the first control mode or the second control mode based on the posture of the attachment.

8. The shovel as claimed in claim 1, wherein the hardware processor is configured to switch between the first control mode and the second control mode depending on a portion of the target of excavation.

9. The shovel as claimed in claim 1, wherein the hardware processor is configured to switch between the first control mode and the second control mode depending on a change of the position information along the predetermined trajectory.

10. The shovel as claimed in claim 1, wherein the attachment includes a boom and an arm provided to the upper pivot body, and the hardware processor is configured to cause the arm to operate depending on the boom.

11. The shovel as claimed in claim 10, wherein the hardware processor is configured to cause the arm to operate along the predetermined trajectory depending on the boom.

12. The shovel as claimed in claim 10, wherein the hardware processor is configured to switch between a first operation of causing the arm to operate depending on the boom and a second operation of causing the boom to operate depending on the arm.

13. The shovel as claimed in claim 1, wherein the hardware processor is configured to switch between the first control mode and the second control mode while moving the predetermined portion of the attachment along the predetermined trajectory set in the target of excavation during an excavation.

14. The shovel as claimed in claim 13, wherein the predetermined trajectory is preset in the target of excavation.

15. The shovel as claimed in claim 1, wherein the hardware processor is configured to operate the plurality of actuators in the first control mode and the second control mode by automatically switching between the first control mode and the second control mode based on the position information while autonomously moving the predetermined portion of the attachment along the predetermined trajectory set in the target of excavation.

16. The shovel as claimed in claim 1, wherein the hardware processor is configured to move the predetermined portion of the attachment along the predetermined trajectory set in the target of excavation by autonomously moving at least one of the plurality of actuators in response to the operation device being operated to move another one of the plurality of actuators.

17. The shovel as claimed in claim 1, wherein the attachment includes a boom mounted on the upper pivot body, an arm attached to a tip of the boom, and a bucket attached to a tip of the arm, the plurality of actuators include a boom cylinder configured to drive the boom, an arm cylinder configured to drive the arm, and a bucket cylinder configured to drive the bucket, and the hardware processor is configured to operate the arm cylinder according as the operation device is operated to operate the arm cylinder, and autonomously operate at least one of the boom cylinder or the bucket cylinder according to an operation of the arm cylinder, in the first control mode, and operate the boom cylinder according as the operation device is operated to operate the boom cylinder, and autonomously operate at least one of the arm cylinder or the bucket cylinder according to an operation of the boom cylinder, in the second control mode.

18. The shovel as claimed in claim 1, wherein the predetermined trajectory includes a first trajectory portion, a second trajectory portion continuing from the first trajectory portion, and a third trajectory portion continuing from the second trajectory portion, and the hardware processor is configured to operate the plurality of actuators in the first control mode in the first trajectory portion, switch the first control mode to the second control mode in response to determining that a distance between the predetermined portion of the attachment and a boundary point between the first trajectory portion and the second trajectory portion along the predetermined trajectory is less than a first predetermined distance, when an angle of the second trajectory portion with respect to the reference plane is greater than or equal to the predetermined angle, and operate the plurality of actuators in the second control mode in the second trajectory portion, and switch the second control mode to the first control mode in response to determining that a distance between the predetermined portion of the attachment and a boundary point between the second trajectory portion and the third trajectory portion along the predetermined trajectory is less than a second predetermined distance, when an angle of the third trajectory portion with respect to the reference plane is less than the predetermined angle, and operate the plurality of actuators in the first control mode in the third trajectory portion.

* * * * *